US011111932B2

(12) United States Patent
Landberg

(10) Patent No.: US 11,111,932 B2
(45) Date of Patent: Sep. 7, 2021

(54) MODULAR FLUID ACTUATOR SYSTEM

(71) Applicant: SAAB AB, Linköping (SE)

(72) Inventor: Magnus Landberg, Linköping (SE)

(73) Assignee: SAAB AB, Linköping (SE)

( * ) Notice: Subject to any disclaimer, the term of this patent is extended or adjusted under 35 U.S.C. 154(b) by 610 days.

(21) Appl. No.: 15/762,931

(22) PCT Filed: Sep. 23, 2016

(86) PCT No.: PCT/SE2016/050904
§ 371 (c)(1),
(2) Date: Mar. 23, 2018

(87) PCT Pub. No.: WO2017/052463
PCT Pub. Date: Mar. 30, 2017

(65) Prior Publication Data

US 2018/0283411 A1 Oct. 4, 2018

(30) Foreign Application Priority Data

Sep. 24, 2015 (WO) ..... PCT/SE2015/050997

(51) Int. Cl.
*F15B 11/18* (2006.01)
*F15B 15/14* (2006.01)
(Continued)

(52) U.S. Cl.
CPC ..... *F15B 11/183* (2013.01); *F15B 15/148* (2013.01); *F15B 15/262* (2013.01);
(Continued)

(58) Field of Classification Search
CPC .... F15B 11/183; F15B 15/148; F15B 15/262; F15B 11/036
(Continued)

(56) References Cited

U.S. PATENT DOCUMENTS 3,457,840 A 7/1969 Grimes
4,526,086 A * 7/1985 Holton ..... F15B 11/18 91/43
(Continued)

FOREIGN PATENT DOCUMENTS

CN 102979784 A 3/2013
CN 102556013 B 3/2014
(Continued)

OTHER PUBLICATIONS

International Search Report and Written Opinion in International Application No. PCT/SE2016/050904, dated Jan. 10, 2017.
(Continued)

*Primary Examiner* — Abiy Teka
*Assistant Examiner* — Daniel S Collins
(74) *Attorney, Agent, or Firm* — Sage Patent Group

(57) ABSTRACT

A modular fluid actuator system is provided for generating a relative motion between a first fluid transfer chamber of a first module unit and a piston rod arrangement in an axial direction.

The modular fluid actuator system comprises a fluid supply, a valve device coupled to the fluid supply and to the first fluid transfer chamber, a control unit coupled to the valve device for controlling the relative motion between the first fluid transfer chamber and the piston rod arrangement, the first fluid transfer chamber is coupled to a first sleeve portion exhibiting a first expandable hollow space arranged for fluid communication with the valve device via the first fluid transfer chamber.

28 Claims, 10 Drawing Sheets

(51) Int. Cl.
*F15B 15/26* (2006.01)
*F15B 11/036* (2006.01)

(52) U.S. Cl.
CPC ..... *F15B 11/036* (2013.01); *F15B 2015/268* (2013.01); *F15B 2211/715* (2013.01)

(58) Field of Classification Search
USPC ..... 91/168
See application file for complete search history.

(56) References Cited

U.S. PATENT DOCUMENTS

| | | | |
|---|---|---|---|
| 4,590,846 | A | 5/1986 | Stoll |
| 5,167,182 | A | 12/1992 | Sims |
| 7,108,108 | B1 | 9/2006 | Heinzeroth |
| 2005/0139061 | A1 | 6/2005 | Timko et al. |

FOREIGN PATENT DOCUMENTS

| | | | |
|---|---|---|---|
| DE | 2119760 | A1 | 11/1972 |
| DE | 2649958 | A1 | 5/1978 |
| DE | 4400743 | A1 | 7/1995 |
| DE | 19714144 | A1 | 1/1998 |
| EP | 0158554 | A1 | 10/1985 |
| SU | 993677 | A1 | 12/1983 |
| WO | 2016080874 | A1 | 5/2016 |

OTHER PUBLICATIONS

European Search Report in corresponding European Application No. 16849112.4 dated May 3, 2019 (13 pages).

* cited by examiner

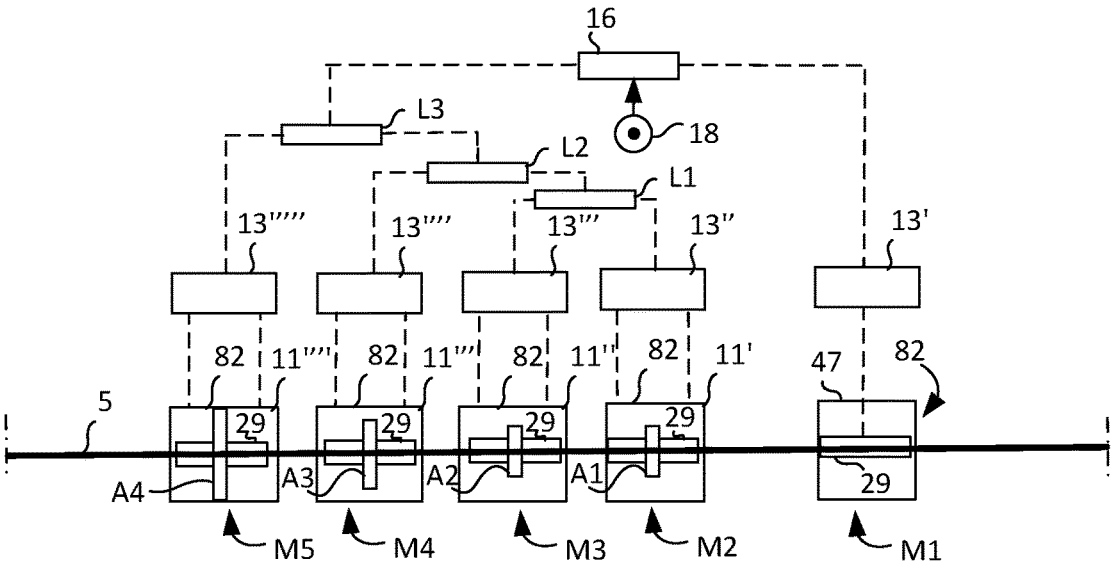
Fig. 13
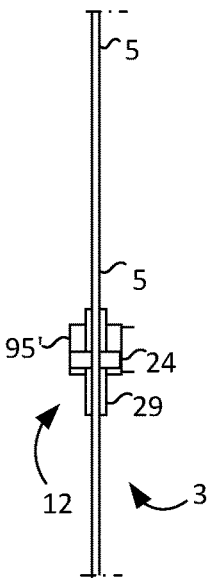
Fig. 14a
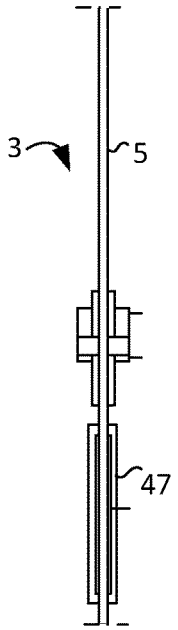
Fig. 14b
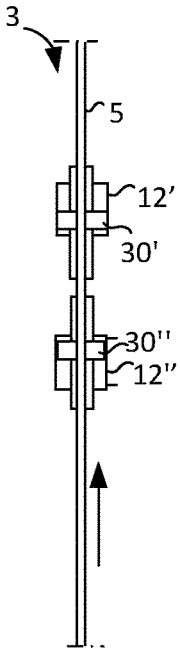
Fig. 14c
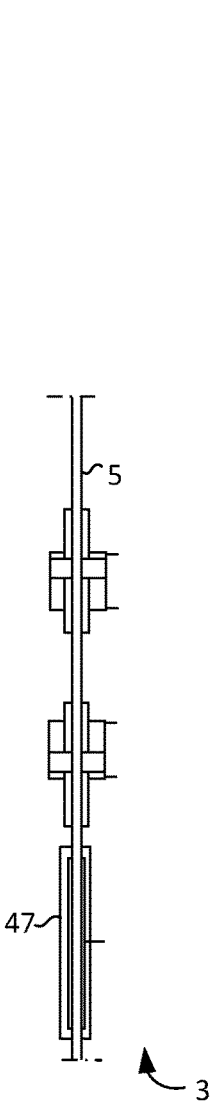
Fig. 14d
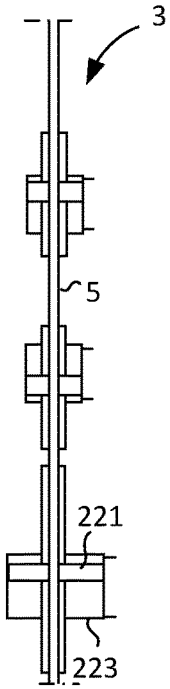
Fig. 14e
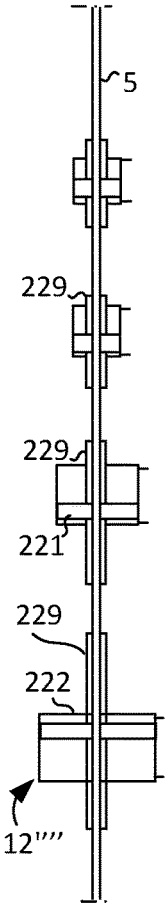
Fig. 14f
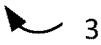

MODULAR FLUID ACTUATOR SYSTEM

CROSS-REFERENCES TO RELATED APPLICATIONS

This application is a U.S. National Stage application of PCT/SE2016/050904, filed Sep. 23, 2016 and published on Mar. 30, 2017 as WO/2017/052463, which claims the benefit of an International Application of PCT/SE2015/050997, filed Sep. 24, 2015, the contents of which are hereby incorporated by reference in their entireties.

TECHNICAL FIELD

The present invention relates to a modular fluid actuator system provided for generating a force of a piston rod relative a cylinder assembly or vice versa in an axial direction. The invention also relates to a standardisation of components that can be applied to such modular fluid actuator system. The invention furthermore relates to the assembly of a modular fluid actuator system in regard to the application of different module units in various combinations.

The present invention concerns the industry using hydraulic and/or pneumatic actuators in compact modular systems. It also concerns the manufacture industry producing such modular fluid actuator systems and components thereof.

BACKGROUND ART

Current modular fluid actuator systems are not standardized for achieving a cost-effective manufacture.

There is no prior art technology that uses standardized fluid actuator components in modular fluid actuator systems for propelling a common piston rod a long distance. Thus, prior art fluid actuators are available in certain unalterable systems and therefore only suitable for limited applications. There is no modular fluid actuator system comprising standardized components designed for cost-effective and easy assembly of the components. There is no modular fluid actuator system that is easy and cost-effective to assembly for different applications regarding load and speed.

In U.S. Pat. No. 4,590,846 is disclosed a modular cylinder construction having a number of axially aligned modular cylinder cells adapted to be joined together, such that aligned piston rods of the cylinder cells project into holes in opposite end cylinder walls. The piston rods are interconnected and the overall length of the piston rod assembly is dependent on the number of cylinder cells.

SUMMARY OF THE INVENTION

There is an object to provide a compact modular fluid actuator system of the type defined in the introduction.

There is an object to provide a modular fluid actuator system that comprises at least one module unit.

A yet further object is to provide a modular fluid actuator system that makes use of combinations of different module units having different piston pressure force areas (piston force areas).

An object is to provide a modular fluid actuator system capable to move a piston rod a long distance without dependency of the length of the cylinder housing.

A yet further object is to provide a modular fluid actuator system that can be used for high speed motion of the piston rod relative the motion of the cylinder housing and that alternately can be used for static locking the piston rod with high locking force, without the need of choking the fluid pressure generated by a fluid supply.

There is thus an object to provide an energy efficient modular fluid actuator system.

An object is to provide discrete scalable modular fluid actuator systems comprising reusable module units.

A yet further object is to provide a modular fluid actuator system comprising well-defined modular interfaces.

There is thus an object of making use of industry standards for such modular interfaces.

A yet further object is to provide a compact modular fluid actuator system that operates with variable speed and force using a minor fluid reservoir.

A yet further object is to, in a cost-effective and simple manner, provide a modular fluid actuator system comprising a modular unit that can be used to brake the piston rod arrangement moved by a first and/or second module unit, i.e. slowing and/or stopping the piston rod arrangement.

A yet further object is to provide a modular fluid actuator system comprising a set of module units, which can be used in the modular fluid actuator system for optional assembly related to a specific use of the modular fluid actuator system providing either a first mode providing a static clamping functionality or a second mode providing a stepwise dynamic clamping functionality or a third mode providing a substantially pulsation-free dynamic clamping functionality.

A yet further object is to provide a modular fluid actuator system having as few components as possible.

This or at least one of said objects has been achieved by a modular fluid actuator system provided for generating a relative motion between a first fluid transfer chamber of a first module unit and a piston rod arrangement in an axial direction, the modular fluid actuator system comprises:

- a fluid supply;
- a valve device coupled to the fluid supply and to the first fluid transfer chamber;
- a control unit coupled to the valve device for controlling the relative motion between the first fluid transfer chamber and the piston rod;
- the first fluid transfer chamber is coupled to a first sleeve portion exhibiting a first expandable hollow space arranged for fluid communication with the valve device via the first fluid transfer chamber;
- the first expandable hollow space is arranged to provide a clamping action of the first sleeve portion to the piston rod arrangement when the first expandable hollow space is pressurised by means of said fluid communication.

In such way is provided a modular fluid actuator system comprising a module unit that can be used for single-acting propulsion of the piston rod relative the module unit (or vice versa) and for pulsation-motion performance in a compact and cost-effective way and with low complexity.

In such way is achieved a modular fluid actuator system comprising a piston rod. The modular fluid actuator system can in such way be made compact by use of a single module unit for providing the relative motion. Such relative motion provided by a single module unit may imply a pulsating intermittent relative motion, which may be preferred in applications using a less complex modular fluid actuator system. The modular fluid actuator system comprising a single module unit may thus be more cost-effective to arrange than a modular fluid actuator system comprising a plurality of co-operating module units. The modular fluid actuator system comprising a single module unit may also at the same time be more compact than a modular fluid actuator system comprising a plurality of co-operating module units.

In such way is achieved a cost-effective manufacture of a large amount of standardized first sleeve portions, each of which can be used as a component for either a brake module unit or an actuator module unit. The first sleeve portions are similar to each other in view of their design and therefore adaptable to be used as components for the brake module units and the actuator module units. Such module units of the modular fluid actuator system are also interchangeable.

The pulsating intermittent relative motion is made by using the first sleeve portion comprising a first piston rod engagement wall portion that partially forms the first expandable hollow space. The first piston rod engagement wall is positioned between the first expandable hollow space and the piston rod outer envelope surface. When the first expandable hollow space is pressurized, the piston rod engagement wall will expand in radial direction inward and in a direction towards the piston rod outer envelope surface for a clamping action.

By the pressurizing of the first hollow space, there is achieved a clamping force of a first piston body (when the first sleeve portion is used as a portion of a first piston body being a module component of an actuator module), which clamping force will secure (clamp) the first piston body to the piston rod in an engagement cycle. As the pressurized fluid used for generating the clamping force of the first piston body also is utilized for propelling the first piston body relative the first cylinder housing or vice versa, there is achieved a modular system that is cost-effective to use.

The modular fluid actuator system provides and maintains accurate location and concentricity between engagement and disengagement cycles. The first sleeve portion module unit is arranged for holding high axial thrust, radial load and torque with high degree of stiffness during the engagement to the piston rod.

The modular fluid actuator system provides high clamping efficiency also at low pressure in the pressurized hollow space (membrane) of the first sleeve portion and provides tight clamping.

By the set-up of the standardized sleeve portion module components, the standardized piston portion module components, the standardized cylinder house module components, the standardized valve devices and the piston rod, the size and desired performance of the modular fluid actuator system can be tailor-made from the needs of the customer.

Suitably, the first fluid transfer chamber is formed by a first fluid connection body or formed by a first cylinder housing.

In such way is achieved cost-effective manufacture of the first module units of the modular fluid actuator system.

By the pressurizing of the first hollow space, there is achieved a stationary clamping force of the brake module (when the first sleeve portion is used as a module component of a brake module unit), which clamping force will lock the piston rod relative the first sleeve portion.

Preferably, the first sleeve portion comprises a first piston portion (fixedly mounted to the first sleeve portion) having a first piston face, the first piston portion is movable arranged in said axial direction within the first cylinder housing.

Alternatively, the first sleeve portion constitutes a module component of a first actuator module unit.

Suitably, the first sleeve portion comprises a first piston portion, which comprises a first channel system arranged for fluid communication between the first expandable hollow space and the first cylinder housing.

Thereby is provided that the first sleeve portion can be used as a module component in the first cylinder housing.

Preferably, the first piston portion is positioned in a middle section (seen in the axial direction) of the first sleeve portion and protrudes in transverse direction (radially) outward from a first outer envelope surface of the first sleeve portion.

Suitably, the first piston portion forms a first piston face and an opposite second piston face (the faces extend in transverse to the axial direction).

The first piston portion can also be made integral with the first sleeve portion forming a first module component used as a module component of an actuator module unit.

Preferably, the first outer envelope surface of the first sleeve portion is slidingly carried in first bearings mounted in mutually opposite end walls of the first cylinder housing.

By using standardized types of first sleeve portions for the assembly of both brake modules and actuator modules, there is achieved a cost-effective manufacture of the module system.

Preferably, a first inner cylindrical surface of the first sleeve portion is arranged for clamping (pressurizing the first expandable hollow space with a first pressure) or sliding (pressurizing the first expandable hollow space with a second pressure) relative the piston rod (during a disengagement cycle).

Suitably, the first pressure is higher than the second pressure, wherein by the first pressure the piston rod engagement wall will expand in radial direction inward and in a direction towards the piston rod outer envelope surface for a clamping action. The second pressure permits the piston rod engagement wall material to return to its original shape and size. That is, when the forces of the first pressure causing the expansion of the piston rod engagement wall material no longer prevail, the elasticity of the piston rod engagement wall material will permit the piston rod engagement wall to return to its original shape wherein the first sleeve portion can slide along the piston rod (during a disengagement cycle).

In such way the first inner cylindrical surface of the first sleeve portion, providing the clamping action, can be used in a first module unit (brake) or in an actuator module unit (for propelling the piston rod relative the first cylinder housing or vice versa).

Preferably, the first sleeve portion and the first piston portion integrally constitute a first piston body.

In such way is achieved a cost-effective production of the first module unit.

Preferably, a retraction mechanism is provided for retraction of the first piston portion to a starting point, from which a working stroke will be initiated.

Suitably, the first piston body divides an interior of the cylinder housing into the first cylinder chamber and a second cylinder chamber, the piston body cavity of the first piston body is arranged for fluid communication with the fluid supply via the second cylinder chamber.

Preferably, the first cylinder chamber and/or the second cylinder chamber being coupled to the fluid supply for fluid communication.

In such way is achieved that the retraction stroke can be made by pressurizing the second cylinder chamber, but also that a working stroke can be made by means of the first actuator module unit in the other direction along the axial direction.

Thereby is provided a modular fluid actuator system comprising a first actuator module unit that can be used for double-acting propulsion of the piston rod relative the module unit (or vice versa).

Suitably, an outer envelope surface of the first sleeve portion comprises a fastening member arranged for mounting of a first fluid connection body or a first piston portion.

In such way is achieved a cost-effective production of a module component that can be used in the modular fluid actuator system, both in regard to apply the module component in a first brake module unit and in regard to apply the module component in a first actuator module unit.

Preferably, the fastening member comprises an orifice of a channel system arranged for fluid communication with the hollow space, the orifice being arranged for coupling to an opening of the first fluid connection body or to an orifice of a channel system of said first piston portion.

Thereby is achieved a standardized component (i.e. the first sleeve portion having an expandable hollow space provided for pressurization either via the first fluid connection body, such as a connection pipe, or via the channel system of the first piston portion).

Preferably, the orifice of the (standardized) first sleeve portion is positioned at the outer envelope surface in a predetermined position relative end portions of the first sleeve portion. The predetermined position is suitable symmetrically positioned in a central part (seen in the axial direction) of the first sleeve portion.

In such way will the first fluid connection of a brake module unit be positioned centrally at the same time as if the first sleeve portion is used as module component for the assembly of an actuator module unit, the first piston portion will be positioned centrally onto the first sleeve portion.

Suitably, the fastening member of the first sleeve portion being formed as a threaded hole and a corresponding threaded connection pipe comprises the opening of the first fluid connection body, wherein the first sleeve portion and the first fluid body being arranged to be interconnected for providing the first brake module unit.

Suitably, the fastening member of the first sleeve portion is formed as a hole and a corresponding orifice of the channel system of the first piston portion is arranged to mate with the hole of the first sleeve portion when the first piston portion is mounted to the first sleeve portion.

Preferably, the mounting of the first piston portion to the first sleeve portion is accomplished by tightening an additional fastening member for holding the first piston portion to the first sleeve portion.

Suitably, the fastening of the first piston portion to the first sleeve portion is made by shrink fit.

Preferably, the modular fluid actuator system being made up of individual module units coupled to each other in line axially.

Thereby is achieved that the performance of the modular fluid actuator system can be "tailor-made" (made for a particular purpose) to match a specific demand. For example, the modular fluid actuator system can be made for operational running involving the demand of the exchange of kinetic energy (speed) of the piston rod still without choking pressurized fluid. The same pressure can be used for all running modes. The modular fluid actuator system can also be made for operational running involving the demand of the exchange of different static energy (load) applications, still using the same pressure over all running modes. By making up the modular fluid actuator system comprising module units having different piston force areas there is achieved a modular system that can be adapted to a specific purpose.

By such way is achieved pulsation-free motion performance in a compact and cost-effective way and with low complexity.

In such way is achieved a modular fluid actuator system that can be used in a cost-effective and energy saving way for propelling a load a certain distance.

Preferably, the modular system comprises a brake module unit comprising a first sleeve portion used as a module component.

Suitably, the brake module unit is activated by means of pressurized fluid fed by the fluid supply.

Preferably, the brake module unit is activated by a separate fluid supply.

In such way is achieved a system that can hold the piston rod in case of malfunction of the main fluid supply provided for the actuator module unit.

Suitably, the modular system further comprises a second module unit comprising a second sleeve portion dividing the interior of a second cylinder housing into a third cylinder chamber and a fourth cylinder chamber, a second expandable hollow space of the second sleeve portion is arranged for fluid communication with the fluid supply via at least one of the third and fourth cylinder chamber.

Preferably, the second expandable hollow space is arranged to provide a clamping action of the second sleeve portion to the piston rod arrangement, when the second expandable hollow space is pressurized by means of said fluid communication.

In such way is achieved a modular fluid actuator system comprising two actuator modules that propel the piston rod arrangement continuously a long distance and with pulsation free motion in the axial direction.

Suitably, the second module unit being a brake module unit provided for clamping action to the piston rod arrangement providing static clamping (holding) of the brake module unit on to the piston rod envelope surface.

The modular fluid actuator system can in such way be made compact and non-complex by the use of two single module units for providing the relative motion. Such relative motion implies a pulsating intermittent relative motion, which may be preferred in applications using a less complex modular fluid actuator system.

Preferably, the modular system further comprises a third module unit comprising a third sleeve portion dividing the interior of a third cylinder housing into a fifth cylinder chamber and a sixth cylinder chamber, a third expandable hollow space of the third second sleeve portion is arranged for fluid communication with the fluid supply via at least one of the fifth and sixth cylinder chamber.

In such way is achieved a modular fluid actuator system comprising a set of module units, two of which are dedicated to propel the piston rod arrangement relative the module units in non-pulsated high speed and one of which being a brake module unit provided for clamping action to the piston rod arrangement with high static force.

Alternately pressurizing the respective cylinder housing and hollow space is controlled by the control unit in such way that retraction of one piston body is made when the workings stroke (and clamping action) is made by the other piston body and vice versa and with reciprocal action.

In such way is achieved a modular fluid actuator system providing a static clamping (mode 1) with high force (by a first brake module unit serving as a brake) and alternatively providing a dynamic clamping with high piston rod speed (mode 2) and low force (by a first actuator module unit).

Suitably, the pressurized first cylinder chamber transfers (via a channel system of the first piston body) pressurized fluid to the first hollow space of the first piston body that expands the expandable first piston rod engagement wall portion toward the piston rod providing a clamping action.

Preferably, the measure of the piston force area of the respective first and second actuator module unit being the same.

Suitably, the third module unit is an actuator module unit having a piston force area that is twice as large as one of the first or second actuator module unit.

Preferably, the modular system further comprises a fourth module unit comprising a fourth sleeve portion dividing the interior of a fourth cylinder housing into a seventh cylinder chamber and an eight cylinder chamber, a fourth expandable hollow space of the fourth sleeve portion is arranged for fluid communication with the fluid supply via at least one of the seventh and eight cylinder chamber.

In such way is provided a modular fluid actuator system making use of four module units each having a standardized module component.

In such way is achieved a modular fluid actuator system comprising a set of module units, three of which are dedicated to e.g. alternately propel the piston rod arrangement relative the module units in non-pulsated high speed and one module unit being a brake module unit provided for clamping action to the piston rod arrangement with high static force.

Suitably, the third module unit is an actuator module unit having a piston force area that is twice as large as one of the first or second actuator module unit.

Preferably, the measure of the piston force area of the respective first and second actuator module unit being the same.

Suitably, the fourth module unit being a fourth actuator module unit having a piston force area which is twice as large as the third actuator module.

In such way is provided a modular fluid actuator system making use of a plurality of module units each having standardized module components.

In such way is achieved a modular fluid actuator system comprising a set of module units, four of which are dedicated to e.g. alternately propel the piston rod arrangement relative the module units in non-pulsated high speed and the fifth module unit being a brake module unit provided for clamping action to the piston rod arrangement with high static force.

Preferably, at least the first cylinder housing comprises a fitting member and a mounting member being formed so as to be disposed positioning the first cylinder in a predetermined position relative the piston rod arrangement.

In such way is achieved a modular fluid actuator system comprising an interface mounting that is cost-effective to produce in large amount as the standardized module unit and cylinder housing being produced in large series.

Suitably, at least two module units comprise a fitting member and a mounting member being formed so as to be disposed joining the module units and interconnecting the fittings of the respective module unit.

Preferably, the axial force acting between at least the two module units is taken through the fitting and mounting member.

Suitably, the mounting member is arranged at a distance from at least the first sleeve portion in transverse direction and extends in the axial direction.

Suitably, the mounting member comprises an interface hollow pipe.

The axial distance between the module units and the radial extension of the module units being dependent on the physical dimensions of each piston body (or cylinder body of a brake module unit) and the stroke length of each piston body.

Suitably, the cylinder housing comprises opposite cap ends (opposite end walls), the inner faces of which forming (together with the cylinder housing inner surface) the interior of the cylinder housing.

Suitably, the cap ends may be formed as rectangular flange and/or square flange and/or circular flange.

Preferably, the first piston body extends through at least one of mutually opposite end walls of the cylinder housing.

Suitably, for double-acting module units, wherein input and output pressures are reversed, there will be a propelling force of the actuator module unit being the same independently of which direction the piston body (cylinder housing) is driven.

Suitably, for retraction of the first piston body (or the integral first sleeve piston portion) to a starting position, the piston rod (or the first cylinder housing) is hold in brake position by the first brake module unit. That is, during the retraction stroke of the first piston body, the first hollow space of the first piston body is pressurized with a second pressure providing slidingly motion between the first piston body and the piston rod, while the first brake module is pressurized for providing a clamping action holding the module units in position relative the piston rod.

Preferably, further motion of the piston rod relative the module units or vice versa is achieved by pressurizing the first cylinder chamber again.

Preferably, there is provided a variety of different cylinder housings and piston bodies (piston portions) having different piston force areas, dependent on the load (force) and speed of the piston rod relative the module units.

In such way is achieved an effective modular fluid actuator system that uses a constant fluid pressure and that is flexible in performance in regard to changing mode of operation (selection between speed and load without the need of choking the fluid pressure supplied from the fluid supply).

Preferably, the modular system is arranged for providing a clamping action of the first piston body to the piston rod simultaneously as the first cylinder chamber is pressurized for propelling the first piston body relative the first cylinder housing or vice versa, thus providing a relative motion between the first piston body clamped to the piston rod and the first cylinder housing.

In such way the first piston body alternately can propel the piston rod. The first piston body is accordingly disengaged from the piston rod (by de-pressurizing the cylinder chamber) for permitting a retraction stroke (by means of e.g. a returning mechanism or returning fluid pressure) by sliding the first piston body along the piston rod to a starting point "to have another go" for propelling the piston rod a yet further distance, wherein the first fluid chamber again is pressurized for propelling the piston body (or cylinder housing) at the same time as the piston body is clamped to the piston rod (achieved by direct pressurizing of the first piston body cavity) for propelling the piston rod.

Preferably, the first module unit is arranged in tandem with a second module unit comprising a second piston body slidingly arranged within a second cylinder housing of the second module.

Thereby is achieved that a manufacture of module units is possible in a cost-effective manner. The module units can be made according to a standard design. A user can combine the module units around a piston rod in a compact way using a standardized interface structure to which the module units are mounted.

Suitably, the respective cylinder housing of the module units each being formed with a fitting, and a mounting member being formed so as to be disposed joining two adjacent module units and interconnects the fittings of the respective module unit.

Preferably, the mounting member is elongated and extends in a direction parallel (or co-linear) with the axial direction of the piston rod and the axial force direction.

In such way is achieved that the module units of the system can be coupled to each other in a cost-effective way.

Thereby is achieved a modular system providing a standard design of the modular units promoting compatibility, repeatability, quality and safety.

Suitably, the axial force is taken through the fitting and mounting member.

Thereby is achieved a system which is robust at the same time as mounting of the module units can be made cost-efficiently.

Preferably, the mounting member comprises a tie rod assembly interconnecting the module units.

Preferably the opposite cap ends comprise threaded bores for mounting of tie rods.

Suitably, the mounting member comprises a tie rod assembly interconnecting the module units and also interconnecting the both opposite cylinder end caps of each cylinder housing.

In such way there is provided a modular system (cylinder assembly) preferably using high strength threaded steel rods to hold the opposite cylinder end caps to the cylinder housing.

Preferably, each module unit is arranged with at least four bores at each cylinder end cap. The bores are made for mating four tie rods.

Suitably, in case of larger cylinders, the numbers of tie rods can be sixteen or twenty (or of any suitable number) in order to retain the cylinder end caps subjected to high forces.

Preferably, the dimensions of the tie rods and cylinder end caps are standardized enabling cylinders from different manufacturers to interchange within the same mountings.

Suitably, the tie rods are easily removed for achieving service maintenance of the module unit and for easy exchanging one module unit to another for building a modular fluid actuator system with a specific performance, thus providing an infinite linear actuator according to present demands.

Preferably, the mounting member comprises at least one welding joint interconnecting the module units.

The modular system can thus be made less bulky as the cylinders are welded directly to each other. An outermost positioned face port of the outer cylinder housings may be threaded into or bolted to the outer cylinder housings. This allows that face ports easily can be removed so that the piston bodies in turn can be extracted from the outer cylinder housings for service maintenance.

The welded design thus implies that no stretching of the cylinder assembly will occur at high pressures within the cylinder chamber. The welded design also lends itself to customization. Special features are easily added to the cylinder housings. These may include special ports, custom mounts, valve manifolds, and so on.

Suitably, the interface hollow pipe also constitutes the cylinder housings of each module unit.

In such way is achieved that a compact modular fluid actuator system is achieved, wherein the axial force is taken through hollow pipe and screws used as fittings.

Preferably, the fittings are oriented transversely to the axial direction.

This implies a cost-effective service of the cylinder assembly as ends of the fittings (e.g. screw heads) face away from the cylinder housing, which implies that service personnel easy can access the fittings. At the same time the transversely oriented fittings in an optimal way will take (shear forces) identical loads for both operative directions in case of double-acting modular fluid actuator systems.

Suitably, the pressurizing of the first cylinder housing controlled by the pilot valve can be achieved by a remotely arranged control unit at the same time as the single electric cabling (including the electrical wires from the pilot valve) provides flexibility and compactness of the system.

The piston rod (may be called "infinite" piston rod) defined in this context may also be defined as a piston rod extending through at least one module unit and wherein the length of the piston rod is longer than twice the length (or ten times or more) of the cylinder housing. This implies that such piston rod, by means of one and the same piston body, can be moved a longer distance than the length of a separate piston body stroke length in the cylinder housing.

The definition of piston force area (piston face area) is a face of the piston body facing that cylinder chamber of the cylinder housing having the highest fluid pressure or any face of the piston body facing a cylinder chamber to be pressurized for propelling the piston body clamped to the piston rod or propelling the cylinder housing (the piston rod is stationary and the piston body clamped to the piston rod thus propelling the cylinder housing).

This means that the pull force can be the same, since the both opposite piston force areas of the piston body suitably have same piston force area. Preferably, a common pressurized fluid is used for the modular system.

The interface mounting structure may comprise extended tie rods at the cylinder housing end module units. The interface mounting structure may comprise welding joints for relative fixation of the module units to each other. The module units may also comprise bayonet catch member for locking the module units to the interface mounting structure.

The statement that the first hollow space is provided for fluid communication with the valve device via the first fluid transfer chamber coupled to the first sleeve portion module component may also be interpreted as that the first fluid transfer chamber corresponds to a first interior (e.g. first cylinder chamber) of the first cylinder housing module component in which the first sleeve portion module component (entirely or partially) is slidingly arranged.

The first fluid transfer compartment can be defined as a room provided adjacent the sleeve portion module component and in contact with an outer envelope surface of the sleeve portion module component. The room can be the interior of a connection pipe module component or an interior of a cylinder housing module component.

A first clamping sleeve module component of a first actuator module unit having a larger piston force area than that of a second actuator module unit, preferably exhibits a longer extension seen in the axial direction than a second clamping sleeve module unit of the second actuator module unit.

This is solved by a modular fluid actuator system provided for generating a relative motion between a first fluid transfer chamber of a first module unit and a piston rod arrangement in an axial direction, the modular fluid actuator system comprises; a fluid supply; a valve device coupled to the fluid supply and to the first fluid transfer chamber; a control unit coupled to the valve device for controlling the relative motion between the first fluid transfer chamber and the piston rod arrangement; the first fluid transfer chamber is coupled to a first sleeve portion of the first module unit exhibiting a first expandable hollow space, which is coupled to and arranged for fluid communication with the valve device via the first fluid transfer chamber; the first expandable hollow space is arranged to provide a clamping action of the first sleeve portion to the piston rod arrangement when the first expandable hollow space is pressurised by means of said fluid communication.

Suitably, the relative motion between the first fluid transfer chamber and the piston rod arrangement is defined as a motion of the piston rod arrangement relative the first fluid transfer chamber and relative the first module unit (the first module unit comprises the first fluid transfer chamber, which constitutes a portion of the first module unit), which relative motion is controlled to be performed by the second module unit and/or the third module unit and when the first module unit is disengaged from the piston rod arrangement.

Preferably, an expandable wall portion of the first sleeve portion is arranged adjacent around and co-axial with the piston rod arrangement.

Suitably, the expandable wall portion partially forms the first expandable hollow space.

Preferably, the control unit is provided for controlling the relative motion by pressurizing the first expandable hollow space with a second pressure for disengagement of the first module unit from the piston rod arrangement.

Suitably, the system further comprises a second module unit comprising a second sleeve portion dividing an interior of a first cylinder housing of the second module unit into a first and second cylinder chamber, wherein a second expandable hollow space of the second sleeve portion is arranged for fluid communication with the fluid supply via a second fluid transfer chamber coupled to the second expandable hollow space and positioned exterior (outside) of said first cylinder housing.

Preferably, an expandable wall portion of the second sleeve portion is arranged adjacent around and co-axial with the piston rod arrangement.

Suitably, the expandable wall portion partially forms the first expandable hollow space.

Preferably, the expandable wall portion of the second sleeve portion is arranged to be expandable radially inward toward the piston rod arrangement for engagement of the second module unit to the piston rod arrangement.

Suitably, the second sleeve portion comprises a first piston portion comprising a respective first and second piston face, wherein the first piston portion and a middle section of the second sleeve portion are fixedly mounted to each other and are movable arranged for motion in said axial direction within the first cylinder housing.

Preferably, exterior end sections of the second sleeve portion protrude from the first cylinder housing outside the first cylinder housing in the axial direction and at least one exterior end section comprises said second external fluid inlet port.

Suitably, the first fluid transfer chamber comprises a first external fluid inlet port and the second fluid transfer chamber comprises a second external fluid inlet port.

Alternately, the first external fluid inlet port is coupled to the fluid supply via the valve device which in turn is coupled to the control unit for controlling and providing a static clamping functionality in a first mode for operation of the system.

Preferably, the second external fluid inlet port is coupled to the fluid supply via a first separate valve element which in turn is coupled to the control unit for controlling and providing a stepwise dynamic clamping functionality in a second mode for operation of the system.

Suitably, the first cylinder chamber and the second cylinder chamber are coupled to the fluid supply via a first valve member which in turn is coupled to the control unit for controlling and providing a stepwise dynamic clamping functionality in a second mode for operation of the system and providing a reciprocating motion of the first piston portion in the axial direction.

Preferably, the system further comprises a third module unit comprising a third sleeve portion dividing an interior of a second cylinder housing of the third module unit into a first and second cylinder chamber, wherein a third expandable hollow space of the third sleeve portion is arranged for fluid communication with the fluid supply via a third fluid transfer chamber coupled to the third expandable hollow space comprising a third external fluid inlet port and positioned exterior (outside) of said second cylinder housing.

Suitably, the third sleeve portion comprises a second piston portion comprising a respective first and second piston face, wherein the second piston portion and the third sleeve portion are fixedly mounted to each other and are movable in said axial direction.

Preferably, the second piston portion and a middle section of the third sleeve portion are fixedly mounted to each other and are movable arranged for motion in said axial direction within the second cylinder housing.

Suitably, exterior end sections of the third sleeve portion protrude from the second cylinder housing in the axial direction and at least one exterior end section comprises said third external fluid inlet port.

Preferably, the first cylinder chamber and the second cylinder chamber of the third module unit are coupled to the fluid supply via a second valve member which in turn is coupled to the control unit for controlling and providing a substantially pulsation-free dynamic clamping functionality in a third mode for operation of the system and providing counter-acting reciprocating motion of the respective second sleeve portion and the third sleeve portion in the axial direction for alternately clamping action around the piston rod arrangement.

Suitably, the third external fluid inlet port is coupled to the fluid supply via a second separate valve element, which in turn is coupled to the control unit for controlling and providing a substantially pulsation-free dynamic clamping functionality in a third mode for operation of the system and provided for co-acting operation with the first separate valve element.

Preferably, the first module unit is configured to act as a brake module unit of the modular fluid actuator system.

Suitably, exterior end sections of the third sleeve portion protrude from the second cylinder housing in the axial direction and at least one exterior end section comprises said third external fluid inlet port.

Preferably, an expandable wall portion of the third sleeve portion is arranged adjacent around and co-axial with the piston rod arrangement.

Suitably, the expandable wall portion partially forms the third expandable hollow space.

Preferably, the expandable wall portion of the third sleeve portion is arranged to be expandable radially inward toward the piston rod arrangement for engagement of the third module unit to the piston rod arrangement.

This is solved by a method for providing an assembly of a modular fluid actuator system according to any of claims 1-31, which modular fluid actuator system comprises a first module unit for providing a static clamping functionality in a first mode and/or comprising a second module unit for providing a stepwise dynamic clamping functionality in a second mode.

Suitably, the method further comprises the application of a third module unit to the assembly for providing a substantially pulsation-free dynamic clamping functionality in a third mode.

This is solved by a method for operation of a modular fluid actuator system according to any of claims 1-31, the method comprises the steps of; pressurizing of the first expandable hollow space with a first pressure for providing an engagement of the first module unit to the piston rod arrangement; pressurizing of the second expandable hollow space of the second sleeve portion of the second module unit for providing an engagement of the second module unit to the piston rod arrangement.

Preferably, the method further comprises the step of: pressurizing of the third expandable hollow space of the third sleeve portion of the third module unit for providing an engagement of the third module unit to the piston rod arrangement.

Suitably, the method further comprises the steps of; pressurizing of the first expandable hollow space with a first pressure for providing an engagement of the first module unit to the piston rod arrangement; pressurizing of the second expandable hollow space of the second sleeve portion of the second module unit with a second pressure for providing a disengagement of the second module unit from the piston rod arrangement and/or pressurizing of the third expandable hollow space of the third sleeve portion of the third module unit with a second pressure for providing a disengagement of the third module unit from the piston rod arrangement.

Alternately, the first pressure is higher than the second pressure, wherein the first pressure expands the expandable wall portion of the first and/or second and/or third sleeve portion expanding in radial direction inwardly and toward the piston rod arrangement for a clamping action.

Preferably, the second pressure permits the expandable wall portion of the first and/or second and/or third sleeve portion to return to its original shape and size for disengagement of the first and/or second and/or third module unit.

Preferably, the fluid supply comprises a first separate fluid supply source coupled to the first fluid transfer chamber.

Suitably, the fluid supply comprises a second separate fluid supply source coupled to the second fluid transfer chamber.

Preferably, the fluid supply comprises a third separate fluid supply source coupled to the third fluid transfer chamber.

Suitably, the first sleeve portion of the first module unit exhibiting a first expandable hollow space is configured to be used as a component of the second sleeve portion of the second module unit.

Preferably, the first sleeve portion of the first module unit exhibiting a first expandable hollow space is configured to be used as a component of the third sleeve portion of the third module unit.

Suitably, the modular fluid actuator system is achieved by that:

the arrangement of the first module unit comprises the first fluid transfer chamber, which is positioned at an end section of the first sleeve portion and by that;

the arrangement of the second fluid transfer chamber is positioned exterior (outside) of said first cylinder housing at an end section of the second sleeve portion and by that;

the arrangement of the third fluid transfer chamber is positioned exterior (outside) of said second cylinder housing at an end section of the third sleeve portion.

The end section is defined as a section of the sleeve portion that protrudes from the cylinder housing in the axial direction.

Such modular sleeve portions (first, second, third) having the same configuration or possible modular assembly feature configuration or comprehensive configuration will promote cost-effective manufacture of the modular fluid actuator system and cost-effective mounting and service.

By means of arranging the second fluid transfer chamber outside the exterior of the first cylinder housing there is provided a possibility to individually pressurize the second expandable hollow space for clamping action of the second sleeve portion providing a clamping on the piston rod arrangement.

Preferably, the individually pressurization of the second expandable hollow space is provided by means of a directional valve (e.g. on/off-valve) included in the first separate valve element.

In such way is achieved a cost-effective valve arrangement of the modular fluid actuator system.

In such way is achieved a simplified valve arrangement.

In such way is avoided/eliminated so called "force-fight" phenomenon, which otherwise could imply unintentional displacement of the piston rod arrangement relative the first module unit (for example the retraction of the second sleeve portion—and first piston portion—can be made without any risk of unintentional clamping of the second sleeve portion to the piston rod arrangement and thereby unintentional displacement of the piston rod arrangement is avoided.

In such way is achieved a reliable functionality of the modular fluid actuator system.

In such way is achieved that the second expandable hollow space can be pressurized independent of the pressurization of the first and second cylinder chamber, which in turn also implies that a simplified valve arrangement is achieved for the modular fluid actuator system.

Such individual pressurization implies that high pressure (higher pressure than the pressure used for moving the second sleeve portion—and first piston portion—in the first cylinder housing) can be used for a specific application, which in turn implies that the second sleeve portion can be made less bulky.

By means of arranging the third fluid transfer chamber outside the exterior of the second cylinder housing there is provided a possibility to individually pressurize the third expandable hollow space for clamping action of the third sleeve portion providing a clamping on the piston rod arrangement.

Preferably, the individually pressurization of the third expandable hollow space is provided by means of a directional valve (e.g. on/off-valve) included in the second separate valve element.

In such way is achieved a cost-effective valve arrangement of the modular fluid actuator system.

In such way is achieved a simplified valve arrangement.

In such way is avoided/eliminated so called "force-fight" phenomenon, which otherwise could imply unintentional displacement of the piston rod arrangement relative the first module unit (for example the retraction of the third sleeve portion—and second piston portion—can be made without any risk of unintentional clamping of the third sleeve portion to the piston rod arrangement and thereby unintentional displacement of the piston rod arrangement is avoided.

In such way is achieved a reliable functionality of the modular fluid actuator system.

In such way is achieved that the third expandable hollow space can be pressurized independently of the pressurization of the first and second cylinder chamber, which in turn also implies that a simplified valve arrangement is achieved for the modular fluid actuator system.

Such individual pressurization implies that high pressure (higher pressure than the pressure used for moving the third sleeve portion—and second piston portion—in the second cylinder housing) can be used for a specific application, which in turn implies that the second third portion can be made less bulky.

By means of arranging the second fluid transfer chamber outside the exterior of the first cylinder housing (and arranging the third fluid transfer chamber outside the exterior of the second cylinder housing) there is provided a modular component produced in serial production that also can be used as a first sleeve portion.

BRIEF DESCRIPTION OF THE DRAWINGS

The present invention will now be described by way of examples with references to the accompanying schematic drawings, of which:

FIG. 13 illustrates a thirteenth example of a modular fluid actuator system;

FIGS. 14*a* to 14*f* illustrate further examples of a modular fluid actuator system;

DETAILED DESCRIPTION

Hereinafter, embodiments of the present invention will be described with reference to the accompanying drawings, wherein for the sake of clarity and understanding of the invention some details of no importance may be deleted from the drawings.

Figure 1A:
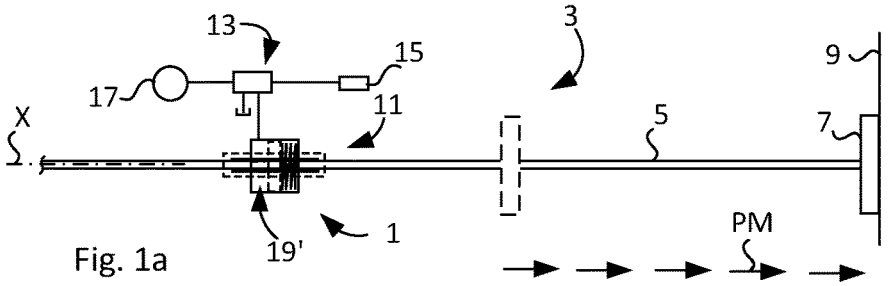
FIGS. 1*a* to 1*c* illustrate a first example of a modular fluid actuator system.
Figure 1B:
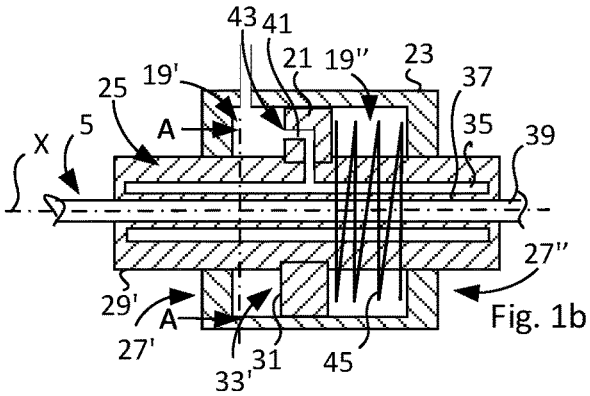
Figure 1C:
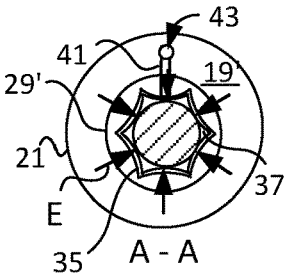

FIG. 1*a* shows a set 1 of module components of a modular fluid actuator system 3 comprising a piston rod 5, which extends in an axial direction X and being coupled to a pusher end 7 connected to a container wall 9. An actuator module unit 11 is arranged around the piston rod 5 and fixed to a floor (not shown) onto which the container wall 9 is going to be pushed. The actuator module unit 11 is connected to a control valve 13, which is controlled by a central control processor 15. The control valve 13 is further coupled to a hydraulic pump 17. The control valve 13 is arranged to control alternately pressurizing of a first cylinder chamber 19' of the actuator module unit 11. The alternately pressurization of the first cylinder chamber 19' provides a pulsated motion of the piston rod 5 according to arrows PM, which motion more also is described by the FIGS. 1*b* and 1*c*. A piston 21 is slidingly arranged in a cylinder housing 23 as shown in FIG. 1*b*. The piston 21 comprises a clamping section 25 that extends in the axial direction X through a first 27' and a second 27" end cap of the cylinder housing 23. The clamping section 25 is formed by a sleeve 29' having a protruding circular portion 31 defining a first piston force area 33' (an area extending transverse to the axial direction X). The first cylinder chamber 19' is arranged for fluid communication with a hollow space 35 that is expandable upon pressurization of the hollow space 35, so that a flexible wall 37 of the sleeve 29' will expand in a direction radially inward towards an envelope surface 39 of the piston rod 5. A channel 41 is provided in the piston 21 and connects the first cylinder chamber 19' and the hollow space 35. The channel 41 has an opening 43 discharging at the first piston force area 33' and is open toward the first cylinder chamber 19'. A second cylinder chamber 19" comprises a compression spring 45 arranged for providing a retraction stroke of the piston 21 (comprising the sleeve 29') when the control valve 13 (see FIG. 1*a*) is controlled to stop the pressurizing of the first cylinder chamber 19'. In such way the pulsated motion is achieved. When the container wall 9 has been pushed to its terminal position, an operator (not shown) switch off the hydraulic pump 17 and brings back the pusher end 7 to a push start position. A cross-section A-A taken in FIG. 1*b* is shown in FIG. 1*c*. When the first cylinder chamber 19' is pressurized, the channel 41 transfers the hydraulic pressure from the cylinder chamber 19' to the hollow space 35 and expands the flexible wall 37 inward (see arrows E) providing a clamping action of the piston 21 21 (comprising the sleeve 29') to the piston rod 5 at the same time as the pressurized first cylinder chamber 19' propels the piston 21 (clamped to the piston rod 5) a predetermined length of a working stroke. The procedure is repeated and the piston rod 5 is moved in a pulsated way.

Figure 2B:
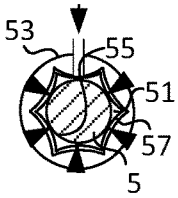
FIGS. 2*a* to 2*d* illustrate module components of a second example of a modular fluid actuator system.
Figure 2A:
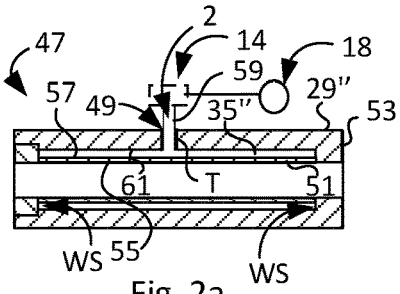
Figure 2D:
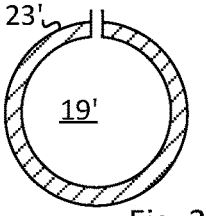
Figure 2C:
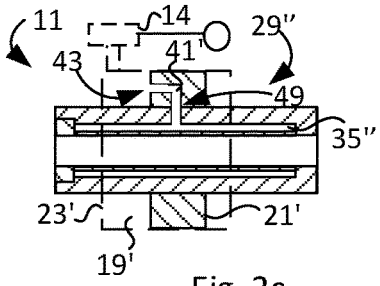

FIG. 2*a* shows a standardized clamping sleeve 29" used as a module component of a brake module unit 47. The clamping sleeve 29" is provided with a standardized coupling entrance 49 for enabling fluid communication between a fluid supply 18 and an elongated and circular slit 35" of the clamping sleeve 29". The slit 35" is formed by an inner sleeve 51 and an outer sleeve 53. A clamping surface 55 of the inner sleeve 51 is arranged for stationary clamping action with a piston rod 5 (see FIG. 2*b*). The inner sleeve 51 further comprises an inner interior surface 57, which together with end wall surfaces WS and an inner surface 61 of the outer sleeve 53 forms the slit 35". The slit 35" is provided for fluid communication with the fluid supply 18 via a valve device 14 and via the standardized coupling entrance 49. A standardized connection pipe 59 is coupled to the standardized coupling entrance 49 by means of a thread T. The clamping force is achieved by that the inner sleeve 51 is arranged to expand in a radial direction inward towards the piston rod 5 during pressurisation of the slit 35" via the standardized connection pipe 59 (comprising a fluid transfer chamber 2). In FIG. 2*c* is shown the standardized clamping sleeve 29" in FIG. 2*a*. The standardized clamping sleeve 29" is used according to FIGS. 2*c*-2*d* as a module component of an actuator module unit 11. A standardized piston portion 21' is mounted to the standardized clamping sleeve 29" in such way that the standardized coupling entrance 49 of the standardized clamping sleeve 29" will be coupled to a channel system 41' of the standardized piston portion 21'. The standardized piston portion 21' is arranged in a standardized cylinder housing 23'. The channel system 41' of the standardized piston portion 21' is arranged to connect a first cylinder chamber 19' of the standardized cylinder housing 23' to the slit 35" for fluid communication. The channel system 41' exhibits an opening 43 discharging at a first piston area of the standardized piston portion 21'. The slit 35" is thus provided for fluid communication with the valve device 14 via the first cylinder chamber 19' and the channel system 41' of the standardized piston portion 21'. The first cylinder chamber 19' is shown in cross-section in FIG. 2*d*.

Figure 3A:
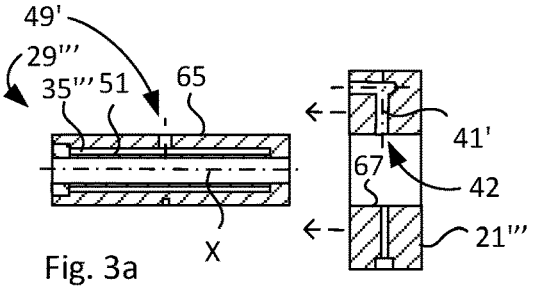
FIGS. 3*a* and 3*b* illustrate a mounting of module components of a third example of a modular fluid actuator system.
Figure 3B:
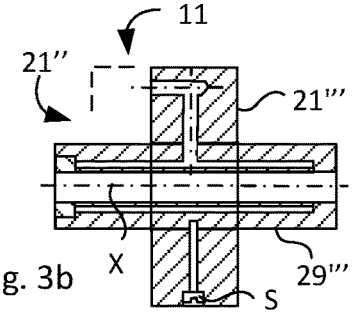

In FIG. 3*a* is shown the assembly of a standardized piston 21" (see FIG. 3*b*) of an actuator module unit 11. A standardized piston ring 21'" is mounted to a standardized clamping sleeve 29'". The standardized clamping sleeve 29'" comprises an expandable space 35'" and an expandable inner sleeve 51 for providing a clamping action to a piston rod (not shown) when pressurized. An orifice 49' is coupled to the expandable space 35'" and leads to an outer envelope surface 65 of the standardized clamping sleeve 29'". The orifice 49' is symmetrically arranged in view of the length of the standardized clamping sleeve 29'" in the axial direction X. An inner surface 67 of the standardized piston ring 21'" exhibits an opening 42 of a channel system 41' of the standardized piston ring 21'". FIG. 3*b* shows the mounted position of the standardized piston ring 21'" relative the standardized clamping sleeve 29'". The orifice 49' of the standardized clamping sleeve 29'" mates with and is coupled to the opening 42 (see FIG. 3*a*) of the channel system 41' of the standardized piston ring 21'". The standardized piston ring 21'" is fixedly attached to the standardized clamping sleeve 29'" by means of screws S (only one is shown).

Figure 4:
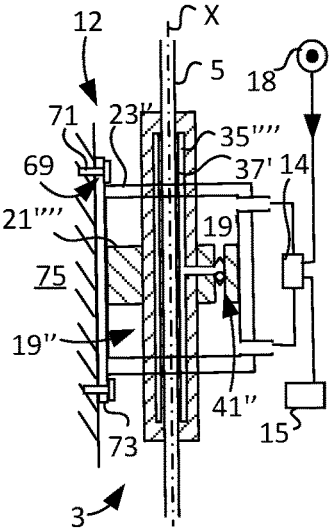
FIG. 4 illustrates an actuator module unit of a fourth example of a modular fluid actuator system.

FIG. 4 illustrates a double-acting actuator module unit 12 used in a modular fluid actuator system 3 for propulsion of a piston rod 5 in both directions. A standardized piston module component 21"" is provided with a channel system 41" for fluid communication between a membrane space 35"" of the standardized piston module component 21"" and respective a first 19' and second 19" cylinder chamber of a cylinder module unit 23". The respective first and second cylinder chamber 19', 19" each being coupled to a control valve (not shown). This double-acting actuator module unit 12 propels the piston rod 5 with pulsated motion as the actuator module unit in FIG. 1*b*, but is capable to make a retraction stroke by means of pressurizing the second cylinder chamber 19". The modular fluid actuator system 3 shown in FIG. 4 is provided for generating a relative motion between the first cylinder chamber 19' and the piston rod 5 in an axial direction X. The modular fluid actuator system 3 comprises a fluid supply 18 and a valve device 14 coupled to the fluid supply 18 and to the respective first and second cylinder chamber 19', 19" representing a fluid transfer chamber. It further comprises a control unit 15 coupled to the valve device 14 for controlling the relative motion between the first cylinder chamber 19' and the piston rod 5. The first cylinder chamber 19' is coupled to (associated with) the standardized piston module component 21"" comprising the membrane space 35"", which is arranged for fluid communication with the valve device 14 via the first cylinder chamber 19'. The membrane space 35"" is arranged for pressurization, thus providing a clamping action to the piston rod 5. This is achieved by the arrangement of an expandable wall 37' of the standardized piston module component 21"" and the expandable wall 37' is arranged between the membrane space 35"" and the piston rod 5. The membrane space 35"" is pressurized by means of said fluid communication. The cylinder module unit 23" comprises four apertures 69 for mounting of screws 71 (two of which are not shown) and a mounting fundament 73 being formed so as to be disposed positioning the cylinder module unit 23" to a base structure 75 in a predetermined position relative the piston rod 5 and an end (not shown) of the piston rod 5.

Figure 5:
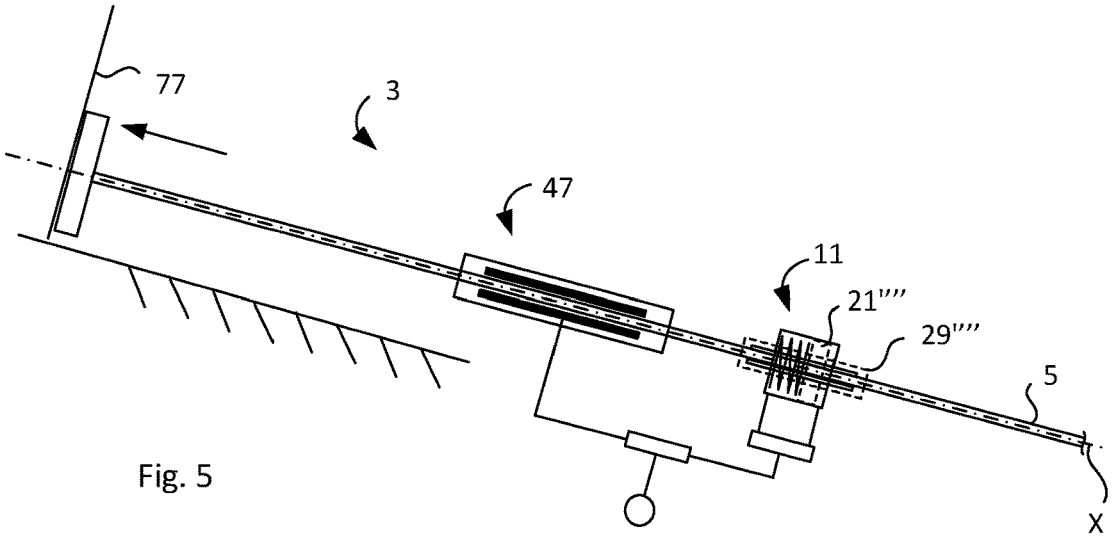
FIG. 5 illustrates a fifth example of a modular fluid actuator system.

FIG. 5 illustrates a modular fluid actuator system 3 comprising an actuator module unit 11 and a brake module unit 47 arranged around a common piston rod 5. The actuator module unit 11 comprises a sleeve portion module component 29"" and a piston portion module component 21""" that are considered as an integrally made standardized piston module component. The modular fluid actuator system 3 is arranged to stepwise move an object 77 upward slope. When the actuator module unit 11 makes a retraction stroke, the brake module unit 47 is activated to clamp around the piston rod 5 and restrain the object 77 to move backwards.

Figure 6A:
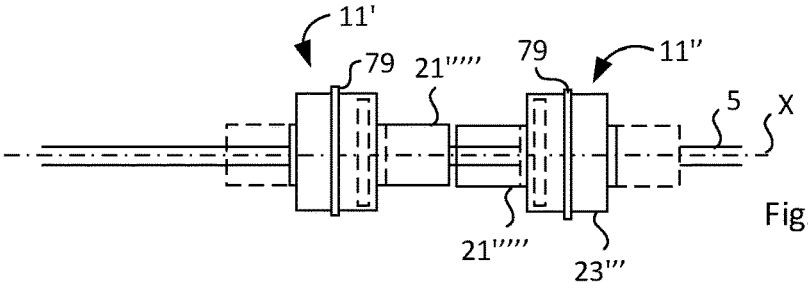
FIGS. 6*a* and 6*b* illustrate a sixth example of a modular fluid actuator system.
Figure 6B:
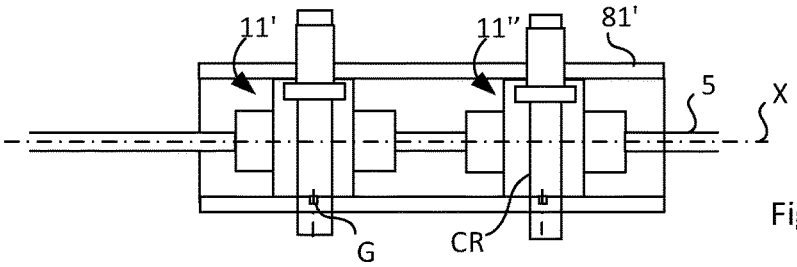

FIG. 6*a* illustrates an example of a set of two actuator module units 11', 11", which can be used as double-acting actuators coupled to a piston rod 5. Each actuator module unit 11', 11" comprises a standardized cylinder module component 23'" and a standardized piston module component 21""" comprising a hollow space and membrane (not shown). The respective hollow space being alternately pressurized depending upon which direction the piston rod 5 will be moved. Each of the cylinder module components 23'" is formed with an interface fixing ridge 79. In FIG. 6*b* is shown both actuator module units 11', 11" mounted in a holding pipe 81'. The respective fixing ridge 79 is fitted in corresponding grooves G of the holding pipe 81'. Clamping rings CR are arranged around the holding pipe 81' for fixing the actuator module units 11', 11" in proper position relative each other. The holding pipe 81' being formed so as to be disposed joining the actuator module units 11', 11" and interconnecting the fixing ridges 79 of the respective module unit 11', 11".

Figure 7A:
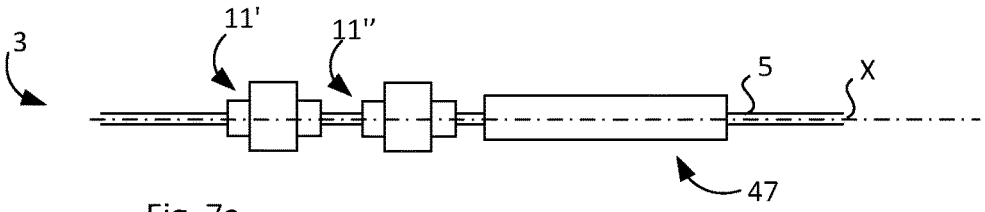
FIGS. 7*a* and 7*b* illustrate a seventh example of a modular fluid actuator system.
Figure 7B:
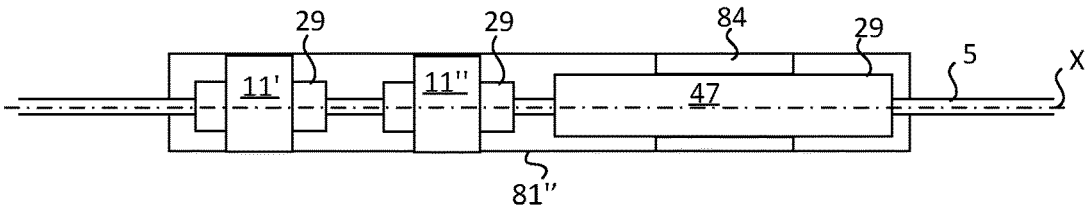

FIGS. 7*a* and 7*b* illustrate two standardized actuator module units 11', 11" and a standardized brake module unit 47 arranged in tandem with each other and around a common piston rod 5. The modular fluid actuator system 3 thus being made up of individual module units coupled to each other in line axially. The two standardized actuator module units 11', 11" being actuated alternately for pulsation-free high speed propulsion of the piston rod 5. The standardized brake module unit 47 is activated for static clamping to the piston rod 5 for holding the piston rod 5 with high clamping force when the two standardized actuator module units 11', 11" are disengaged from the piston rod 5. The standardized brake module unit 47 exhibits a length in the axial direction X, that is longer than the length of each standardized actuator module unit 11', 11", which promotes a high static clamping force. In FIG. 7*b* is shown the assembly of the module units 11', 11", 47 in an interface cylinder 81". The interface cylinder 81" interior is designed with inside fasteners 84 providing a fixed distance (seen in a transversal direction relative the axial direction X) between the interface cylinder 81" and three standardized sleeve module components 29 making parts of the standardized actuator module units 11', 11" and the standardized brake module unit 47.

Figure 8:
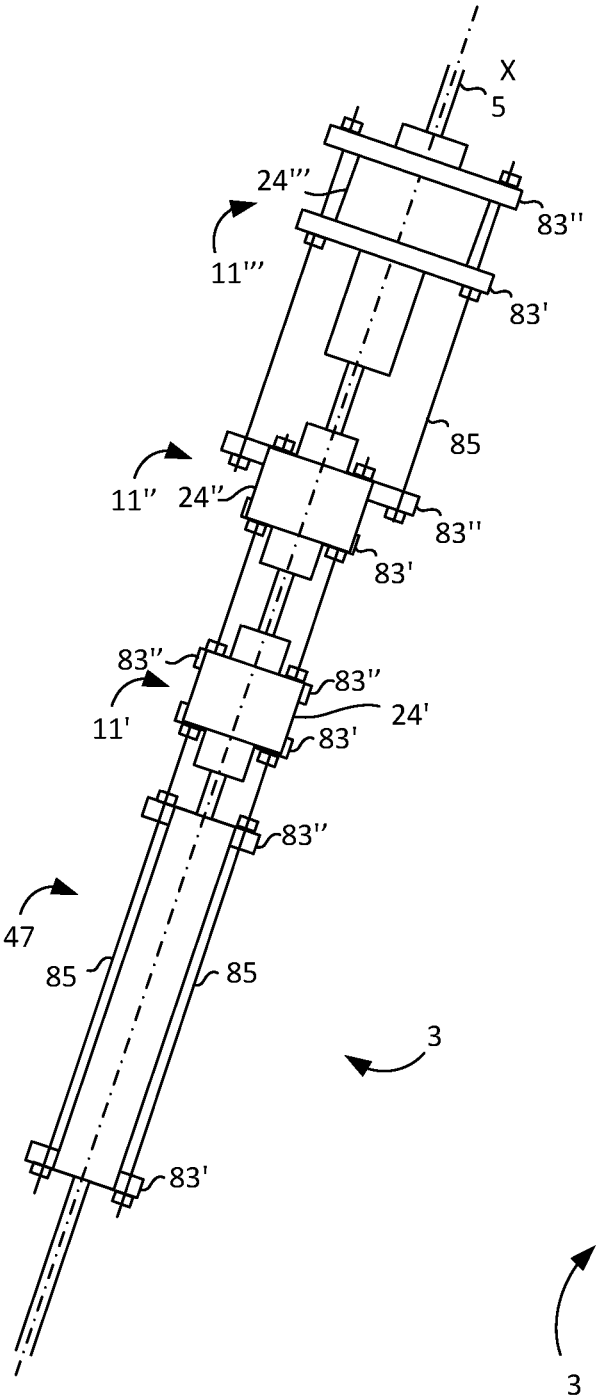
FIG. 8 illustrates an eight example of a modular fluid actuator system.

FIG. 8 illustrates an eight example of a modular fluid actuator system 3. The modular fluid actuator system 3 comprises one brake module unit 47 and three actuator module units (a first 11', a second 11" and a third 11'"), each comprising a cylinder housing module component 24', 24", 24'". The third actuator module unit 11" comprises a piston module component (not shown) having a piston force area that is twice the area of respective piston force area (not shown) of the first 11' and the second 11" actuator module unit. A first and second end cap module 83', 83" component of the respective cylinder housing module component 24', 24", 24'" comprises four through holes. A first set of standardized four tie rods 85 (two of which are shown) being arranged in through holes of the brake module unit 47 and the first actuator module unit 11'. In this modular fluid actuator system 3, the second end cap module component 83" of the second actuator module unit 11" is of the same dimension, in regard to the through hole configuration, as the first end cap module component 83' of the third actuator module unit 11'" and as the first end cap module component 83' of the second actuator module unit 11". The first set of tie rods 85, 85' is in this way coupled to the first end cap module component 83' of the second actuator module unit 11". A second set of four standardized tie rods 85, 85' being arranged in through holes of the second end cap module component 83" of the second actuator module unit 11" and in the both end cap module components 83', 83" of the third actuator module unit 11'". The end cap module components 83', 83" are fixed to the respective cylinder housing module component 24', 24", 24'" by means of standardized hexagon nuts. The length of the standardized tire rods 85, 85' are adapted to the lengths of the actuator module units 11', 11", 11'" and the brake module unit 47 so as to be disposed joining the respective module unit and interconnecting the end cap module components 83', 83" comprising the through holes. The standardized tire rods 85 and end cap module components 83', 83" are selected in dimension to take up the axial forces acting between two adjacent module units. The standardized tire rods 85, 85' are arranged in a perimeter area of the end cap module components 83', 83" at a pre-determined distance from each other and at a pre-determined distance from and parallel with the longitudinal axis X and extending through the module units 11', 11", 11'", 47.

Figure 9:
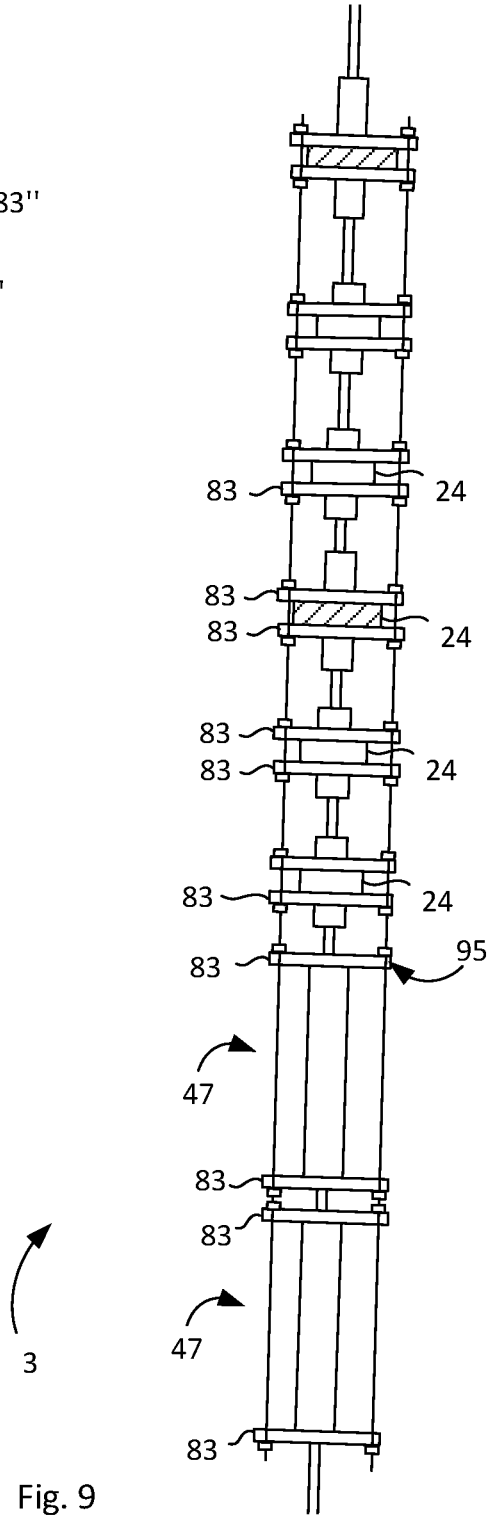
FIG. 9 illustrates a ninth example of a modular fluid actuator system.

FIG. 9 illustrates a ninth example of a modular fluid actuator system 3. This example of the assembly of interacting module units also is custom-made and adapted to a safety redundant system for increasing reliability. The modular fluid actuator system 3 comprises two brake module units 47. The custom-made modular fluid actuator system 3 comprises a set of standardized cylinder end caps 83. Each standardized cylinder end cap 83 exhibits a face area corresponding with a cylinder cross-section area of a mating standardized cylinder housing module component 24. Each standardized cylinder end cap 83 is of the same dimension in circumference and a set of through holes 95 is provided in each standardized cylinder end cap 83. The interrelationship between the through holes 95 is standardized for reaching a cost-effective assembly of the modular fluid actuator system 3.

Figure 10A:
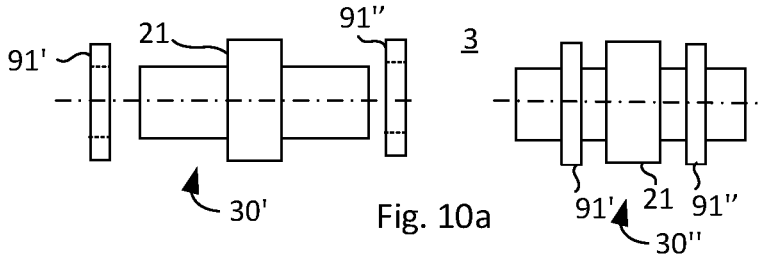
FIGS. 10*a* to 10*d* illustrate a tenth example of a modular fluid actuator system.
Figure 10B:
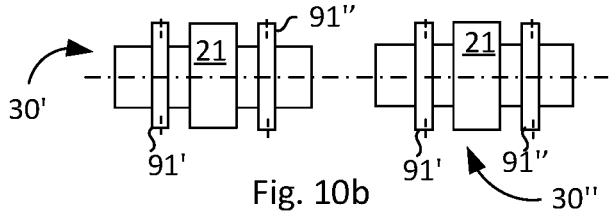
Figure 10C:
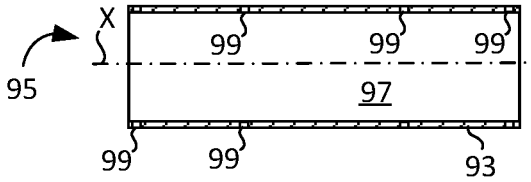
Figure 10D:
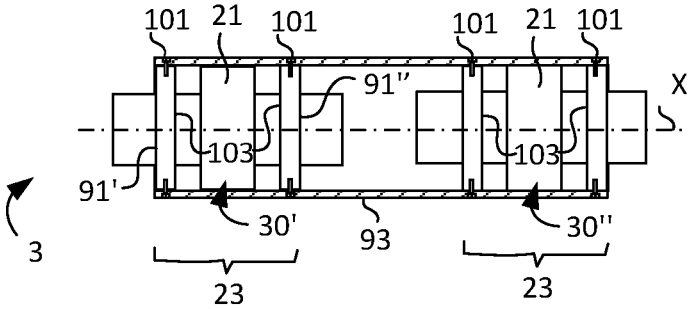

FIGS. 10*a* to 10*d* illustrate a tenth example of a modular fluid actuator system 3 extending along a longitudinal axis. In FIG. 10*a* is shown a first 30' and a second 30" standardized clamping sleeve module component, each comprising a piston portion 21. In FIG. 10*a* is also shown standardized cylinder end wall module components 91', 91" to be mounted to the modular fluid actuator system 3. In FIG. 10*b* is shown that all standardized cylinder end wall module components 91', 91" have been brought onto the respective first and a second standardized clamping sleeve module component 30', 30". In FIG. 10*c* is shown an integral cylinder and mounting member 93. The integral cylinder and mounting member 93 is formed of a standardized cylinder wall module component 95 having a hollow compartment 97 designed for encompassing the both standardized clamping sleeve module components 30', 30" and the standardized cylinder end wall module components 91', 91" shown in FIG. 10*b*. The standardized cylinder wall module component 95 is provided with a plurality of bores 99 provided for fixation of the standardized cylinder end wall module components 91', 91" by means of screws 101 (see FIG. 10*d*). In FIG. 10*d* is shown the assembled module components. The standardized cylinder end wall module components 91', 91" will together with the integral cylinder and mounting member 93 form a respective cylinder housing 23. The standardized cylinder end wall module components 91', 91" are mounted with their respective end wall face 103 having transverse extension relative the longitudinal axis X. The screws 101 are used for fixation of the standardized cylinder end wall module components 91', 91" in the standardized cylinder wall module component 95.

Figure 11:
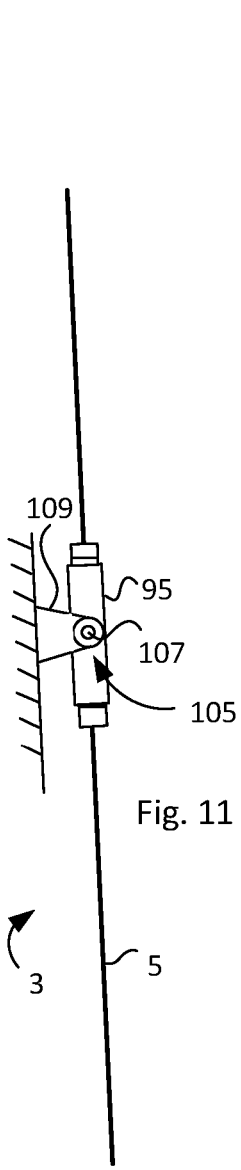
FIG. 11 illustrates an eleventh example of a modular fluid actuator system.

FIG. 11 illustrates an eleventh example of a modular fluid actuator system 3. A standardized cylinder wall module component 95 is provided with a centre trunnion mounting 105, which may comprise a pair of pins 107 or apertures. A bracket module component 109 is coupled to the centre trunnion mounting 105. The standardized cylinder wall module component 95 is pivotally hinged to the bracket module component 109 and the centre trunnion mounting 105 serves as a pivoting point. A piston rod 5 is propelled by the modular fluid actuator system 3.

Figure 12:
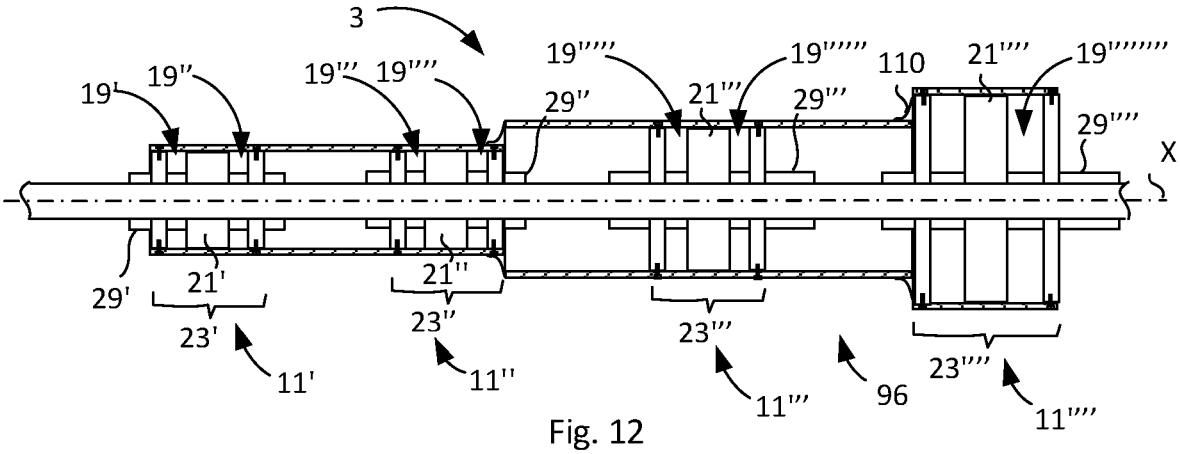
FIG. 12 illustrates a twelfth example of a modular fluid actuator system.

FIG. 12 illustrates a twelfth example of a modular fluid actuator system 3. The modular fluid actuator system 3 is custom-made with four actuator module units 11', 11", 11'", 11"" arranged within a cylinder housing module component 96. The first actuator module unit 11' comprises a first sleeve portion 29' and a first piston portion 21' dividing the interior of a first cylinder housing 23' into a first cylinder chamber 19' and a second cylinder chamber 19". The second actuator module unit 11" comprises a second sleeve portion 29" and a second piston portion 21" dividing the interior of a second cylinder housing 23" into a third cylinder chamber 19'" and a fourth cylinder chamber 19"". The third actuator module unit 11'" comprises a third sleeve portion 29'" and a third piston portion 21'", dividing the interior of a third cylinder housing 23'" into a fifth cylinder chamber 19'"" and a sixth cylinder chamber 19""". The fourth actuator module unit 11"" comprises a fourth sleeve portion 29"" and a fourth piston portion 21"" dividing the interior of a fourth cylinder housing 23"" into a seventh cylinder chamber and an eight cylinder chamber 19"""'. Each sleeve portion 29'-29"" comprises an expandable hollow space (not shown) arranged for fluid communication with a fluid supply (not shown) via at least one of the corresponding cylinder chamber 19'-19"""'. The cylinder housings 23'-23"" are mounted and coupled to each other according to the specific customized modular fluid actuator system 3 capable to perform unique propulsion modes in view of customer needs. The respective integral sleeve 29'-29"" and piston portion 21'-21"" module component is movable arranged (in the axial direction X), within the corresponding cylinder housing 23'-23"" module component 96. The mounting is achieved by welding seams 110. In such way are achieved high strength and structural stability.

FIG. 13 illustrates a thirteenth example of a modular fluid actuator system 3 for propulsion of a piston rod 5. The modular fluid actuator system 3 is custom-made with five module units M1-M5, one of which being a brake module unit 47 comprising a clamping sleeve module component 29 and the other being a first 11', a second 11", a third 11'" and a fourth 11"" actuator module unit. The brake module unit 47 having a mounting member 82, comprising same interface fitting as that of mounting members 82 of the actuator module units 11'-11"". The respective module unit M1-M5 is coupled to a corresponding valve member 13'-13""". A fluid supply 18 is coupled to the first valve member 13', e.g. a directional control valve controlled by a control unit (not shown) via a directional valve 16. The first valve member 13' is coupled to the brake module unit 47 with an on/off functionality. A second valve member 13" is coupled to the first actuator module unit 11'. A third valve member 13"" is coupled to the second actuator module unit 11". A fourth valve member 13"" is coupled to the third actuator module unit 11'" and a fifth valve member 13""" is coupled to the fourth actuator module unit 11"". The second 13" and the third 13'" valve member are coupled to a first logic valve L1. The first logic valve L1 and the fourth valve member 13"" are coupled to a second logic valve L2. The second logic valve L2 and the fifth valve member 13""" are coupled to a third logic valve L3. The directional valve 16 is coupled to the fluid supply 18 and the third logic valve L3. The custom-made modular fluid actuator system 3 comprises standardized module components, such as clamping sleeves, cylinder cap ends, cylinder housings, piston bodies, tire rods etc. for achieving an assembly capable to propel the common piston rod 5 a long distance, with fast motion and minor force, or with high force and slow motion, in an energy saving way. A customer will compose a new set-up of the modular fluid actuator system if the requirements are changed. This is made by the use of the standardized module components in a cost-effective way. The first actuator module unit 11' is provided with a first piston force area A1, the second actuator module unit 11" is provided with a second piston force area A2 corresponding with the first piston force area A1. The third actuator module unit 11'" is provided with a third piston force area A3 and the fourth actuator module unit 11"" is provided with a fourth piston force area A4. The third piston force area A3 is twice as large as the first piston force area A1. The fourth piston force area A4 is twice as large as the third force area A3. The respective piston force area is defined as the cross-sectional area of the respective piston portion. For reaching a fast piston motion and minor force, the first piston force area A1 (or second piston force area A2) (e.g. 1 area unit) is activated by alternating engagement of the first and second actuator module unit 11', 11" to the common piston rod 5. For achievement of an alternative performance of the modular fluid actuator system 3, e.g. slow piston motion with high force, all actuator module units 11', 11", 11'", 11"" are actuated. The high force is achieved by actuating all four piston force areas A1-A4 (e.g. 8 piston force area units=1+1+2+4 area units, i.e. the respective piston force area of the first, second, third, fourth actuator module unit). This implies an optimal combination of eight different piston force area units, which can be selected from required piston motion rate and force of the modular fluid actuator system 3. Each clamping sleeve module component 29 of the five module units M1-M5 comprises an expandable hollow space (not shown) arranged for fluid communication with the fluid supply 18 via at least one of corresponding cylinder chamber (fluid transfer chamber). The valve members 13'-13""" and logic valves L1-L3 are thus arranged for expanding a flexible wall portion of the clamping sleeve module component 29 provided to be expanded towards, and in engagement with, the piston rod 5 when the expandable hollow space being pressurized.

FIGS. 14*a* to 14*f* illustrate further examples of a modular fluid actuator system. FIG. 14*a* illustrates an example of a modular fluid actuator system 3 adapted to a specific customer requirement. A first cylinder module component 95' encompasses a piston portion module component 24 fitted to a clamping sleeve module component 29 provided for clamping action to a piston rod 5. The modular fluid actuator system 3 uses one single double-acting actuator module unit 12. A customer can easy rebuild the modular fluid actuator system 3 in FIG. 14*a* for making a single-acting actuator. By easy re-mounting of the piston portion module component 24 to a piston portion module component having a fluid channel leading to only one cylinder chamber. FIG. 14*b* illustrates yet another example of a modular fluid actuator system 3 adapted to a specific customer requirement. The modular fluid actuator system 3 uses the same standardized components as shown in FIG. 14*a*, but has an additional standardized brake module unit 47 mounted to the piston rod 5. In such way is static holding of the piston rod 5 provided. FIG. 14*c* shows yet another example of a modular fluid actuator system 3 adapted to a specific customer requirement. A pair of identical standardized actuator module units 12', 12" has been assembled. A first actuator module unit 12' comprises a first clamping piston 30'. A second actuator module unit 12" comprises a second clamping piston 30". The standardized components, such as the clamping pistons 30', 30", are cost-effective mounted to the piston rod 5. The first clamping piston 30' divides the interior of a first cylinder housing (not shown) into a first cylinder chamber and a second cylinder chamber. A first expandable hollow space (not shown) of the first clamping piston 30' is arranged for fluid communication with a fluid supply (not shown) via at least one of the first and second cylinder chamber. The second clamping piston 30" divides the interior of a second cylinder housing into a third cylinder chamber and a fourth cylinder chamber. A second expandable hollow space (not shown) of the second clamping piston is arranged for fluid communication with the fluid supply via at least one of the third and fourth cylinder chamber. The actuator module units 12', 12" work alternately for propelling the piston rod 5. When the first actuator module unit 12' holds the piston rod 5 and moves it, the second clamping piston 30" is disengaged from the piston rod 5 and makes a retraction stroke to a starting position. The second clamping piston 30" is engaged with the piston rod 5 and makes a working stroke for propulsion of the piston rod 5, meantime the first clamping piston 30' retracts to a starting position. The procedure is repeated and the piston rod 5 moves upward. FIG. 14*d* illustrates a further example of a remounted modular fluid actuator system 3 adapted to a specific customer requirement. The customer has added a brake module unit 47 for secure static locking of the piston rod. FIG. 14*e* illustrates a further example of a remounted modular fluid actuator system 3 adapted to a specific customer requirement. In this modular arrangement, the brake module unit 47 in FIG. 14*d* is replaced by a third standardized cylinder housing module component 223 and a third standardized piston body module unit 221 having a larger piston force area than the pair of similar standardized actuator module units shown in FIG. 14*d*. FIG. 14*f* illustrates a yet further example of a rebuilt modular fluid actuator system 3 adapted to a specific customer requirement. The modular fluid actuator system 3 is added with a fourth actuator module unit 12"" providing additional modes of operation. A standardized piston body module component 222 (with twice as large piston force area as that of the third standardized piston body module unit 221) is mounted on a standardized clamping sleeve 229 that also may be used in any other context and in other modular fluid actuator systems. The modular fluid actuator system promotes energy-saving propulsion of a piston rod at the same time as it is easy to install and provides cost-effective maintenance and service. By means of a software product or other data list, a designer quickly will find an optimal set-up of a modular fluid actuator system through logic-guided standard module type code queries.

The modular fluid actuator system, brake module units, actuator module units, clamping sleeve module components etc. may according to different aspects be adapted to one or several of following industrial segments; construction industry, jacking systems for oil well drilling and service platforms, agricultural equipment industry, marine industry, crane manufacture industry. The arrangement is not limited to be used in such segments, but also other industrial segments are possible.

Figure 15:
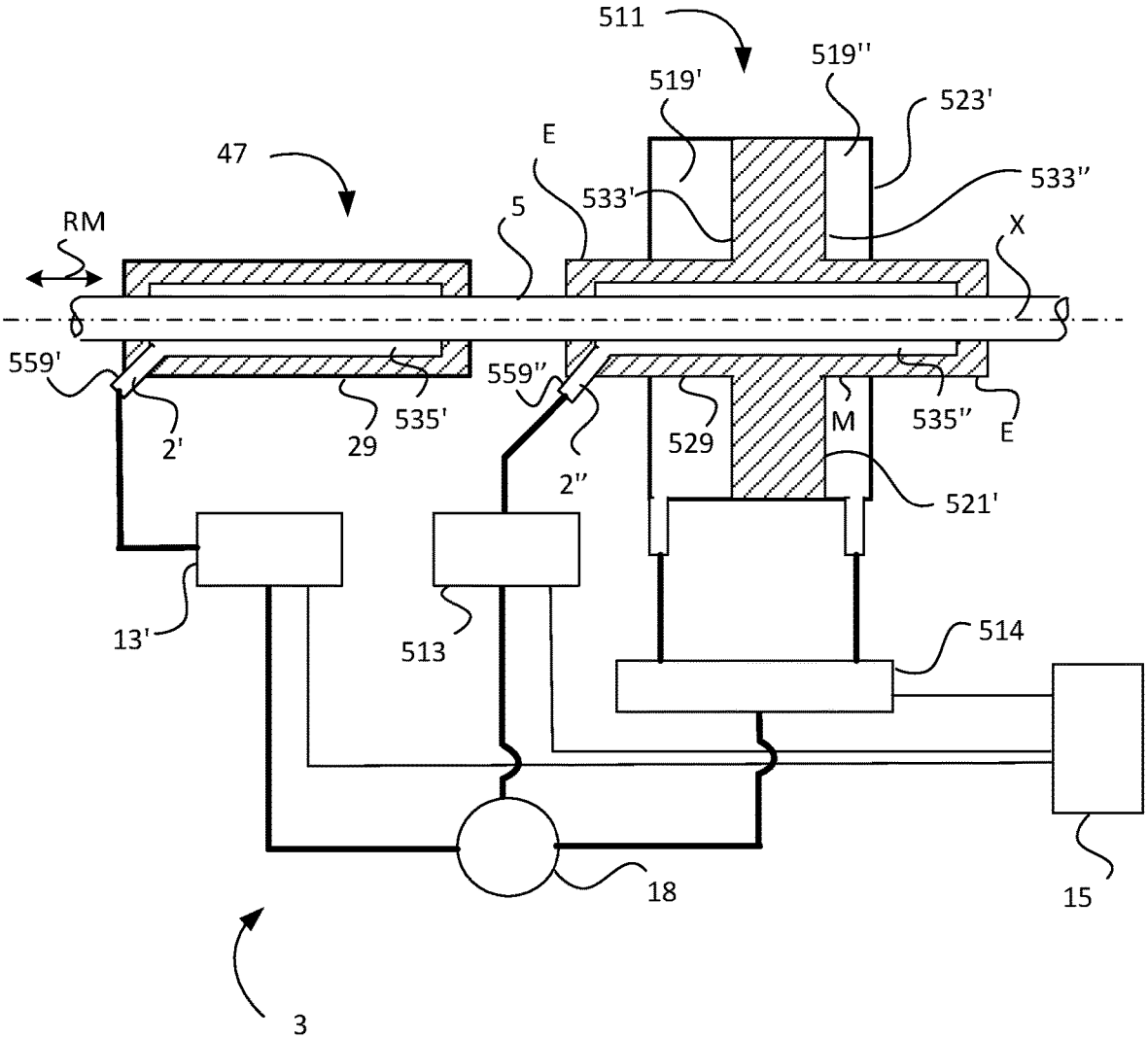
FIG. 15 illustrates a modular fluid actuator system according to one aspect of the invention.

FIG. 15 illustrates a modular fluid actuator system 3 provided for generating a relative motion RM between a first fluid transfer chamber 2' of a first module unit 47 and a piston rod 5 in an axial direction X. The system 3 comprises a fluid supply 18 which is coupled to a valve device 13'. The valve device 13' is coupled to the first fluid transfer chamber 2'. The first fluid transfer chamber 2' comprises and is formed by a first external fluid inlet port 559'. A control unit 15 is coupled to the valve device 13' for controlling the relative motion RM between the first fluid transfer chamber 2' and the piston rod arrangement 5. The first external fluid inlet port 559' is coupled to a first sleeve portion 29 of the first module unit 47 exhibiting a first expandable hollow space 535', which is coupled to and arranged for fluid communication with the valve device 13' via the first fluid transfer chamber 2'. The control unit 15 is provided for controlling the relative motion by pressurizing the first expandable hollow space 535' with a second pressure for disengagement of the first module unit 47 from the a piston rod 5 (whereby the piston rod can be moved). The first expandable hollow space 535' is arranged to provide a clamping action of the first sleeve portion 29 to the piston rod 5 when the first expandable hollow space 535' is pressurised by means of said fluid communication. The system 3 further comprises a second module unit 511 (provided for moving the piston rod 5) comprising a second sleeve portion 529 dividing an interior of a first cylinder housing 523' of the second module unit 511 into a first 519' and second cylinder chamber 519", wherein a second expandable hollow space 535" of the second sleeve portion 529 is arranged for fluid communication with the fluid supply 18 via a second fluid transfer chamber 2" coupled to the second expandable hollow space 535" and being positioned exterior (outside) of said first cylinder housing 523'. The second fluid transfer chamber 2" comprises and is formed by a second external fluid inlet port 559". The second sleeve portion 529 comprises a first piston portion 521' comprising a respective first and second piston face 533', 533", wherein the first piston portion 521' and a middle section M of the second sleeve portion 529 are fixedly mounted to each other and are movable arranged in said axial direction X within the first cylinder housing 523'. Exterior end sections E of the second sleeve portion 529 are positioned exterior (outside) of the first cylinder housing 523'. The exterior end sections E of the second sleeve portion protrude from the first cylinder housing 523' in the axial direction X and at least one exterior end section E comprises said second external fluid inlet port 559".

The first external fluid inlet port 559' is coupled to the fluid supply 18 via the valve device 13', which in turn is coupled to the control unit 15 for controlling and providing a static clamping functionality in a first mode for operation of the system 3 for providing a static clamping functionality. The second external fluid inlet port 559" is coupled to the fluid supply 18 via a first separate valve element 513 which in turn is coupled to the control unit 15 for controlling and providing a stepwise dynamic clamping functionality (i.e. pulsated motion by alternately pressurization of the first 519' and second cylinder chamber 519") in a second mode for operation of the modular fluid actuator system 3. The first cylinder chamber 519' and the second cylinder chamber 519" are coupled to the fluid supply 18 via a first valve member 514 which in turn is coupled to the control unit 15 for controlling and providing a stepwise dynamic clamping functionality in a second mode for operation of the system 3 and providing a reciprocating motion of the second sleeve portion 529 in the axial direction X. The first module unit 47 is configured to act as a brake module unit of the system 3. The modular fluid actuator system 3 uses the second module unit 511 for providing a stepwise dynamic clamping functionality in a second mode.

Figure 16:
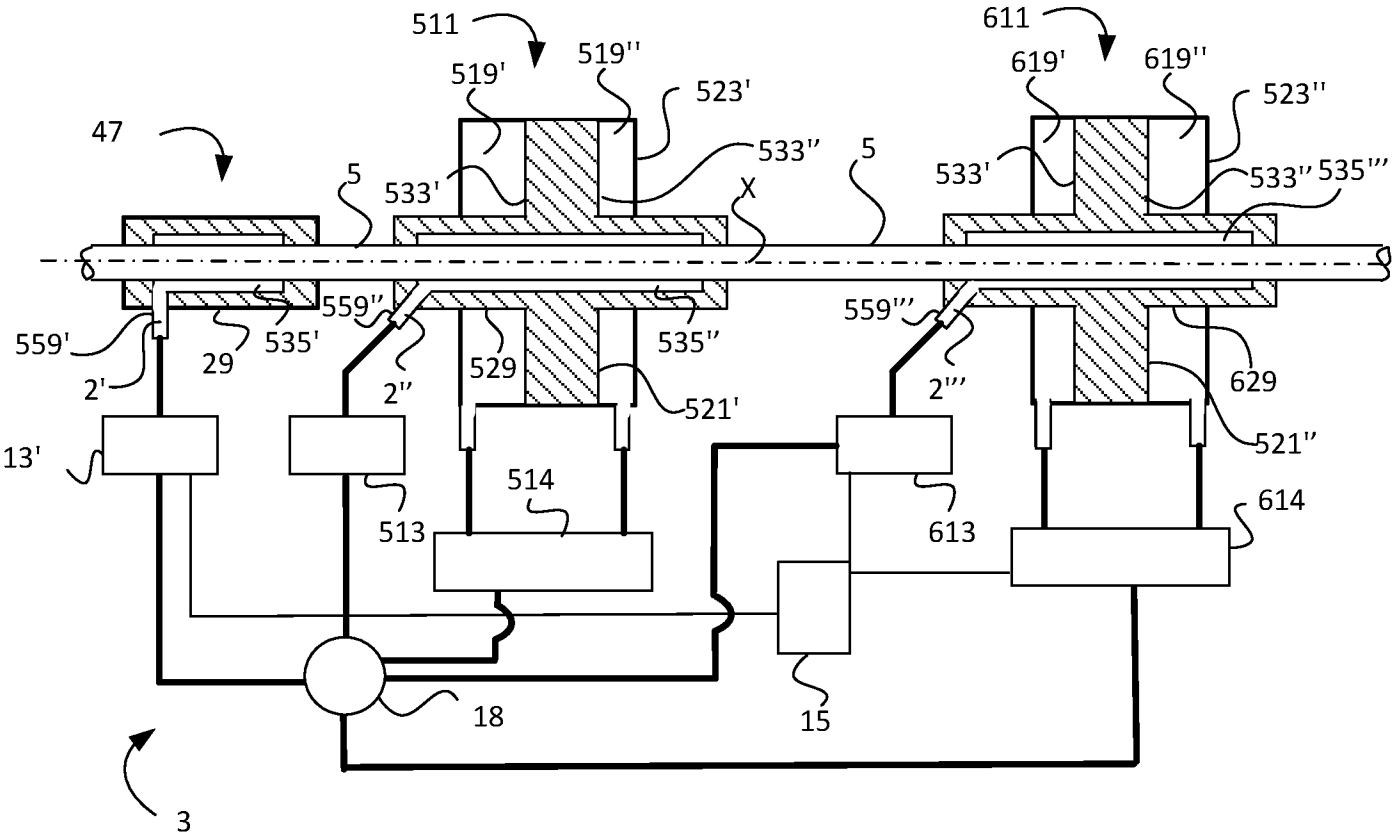
FIG. 16 illustrates a modular fluid actuator system according to one aspect of the invention.

FIG. 16 illustrates a modular fluid actuator system 3 according to one aspect of the invention. FIG. 16 illustrated one embodiment, wherein the modular fluid actuator system 3 further comprises a third module unit 611 comprising a third sleeve portion 629 dividing an interior of a second cylinder housing 523" of the third module unit 611 into a first 619' and second cylinder chamber 619", wherein a third expandable hollow space 535'" of the third sleeve portion 629 is arranged for fluid communication with the fluid supply 18 via a third fluid transfer chamber 2'" coupled to the third expandable hollow space 535'" and comprising a third external fluid inlet port 559'" exterior (outside) of said second cylinder housing 523". The third sleeve portion 629 comprises a second piston portion 521" comprising a respective first and second piston face 533', 533", wherein the second piston portion 521" and the third sleeve portion 629 are rigidly coupled to each other and are movable in said axial direction X. The first cylinder chamber 619' and the second cylinder chamber 619" are coupled to the fluid supply 18 via a second valve member 614 which in turn is coupled to the control unit 15 for controlling and providing a substantially pulsation-free dynamic clamping functionality in a third mode for operation of the modular fluid actuator system 3 and providing counter-acting reciprocating motion of the respective second sleeve portion 529 and the third sleeve portion 629 in the axial direction X for alternately clamping action around the piston rod arrangement 5. The third external fluid inlet port 559'" is coupled to the fluid supply 18 via a second separate valve element 613 which in turn is coupled to the control unit 15 for controlling and providing a substantially pulsation-free dynamic clamping functionality in a third mode for operation of the system 3 provided for co-acting operation with the first separate valve element 513. The first module unit 47 is configured to act as a brake module unit of the system 3. The system 3 uses the third module unit 611 for providing a substantially pulsation-free dynamic clamping functionality in a third mode.

Figure 17A:
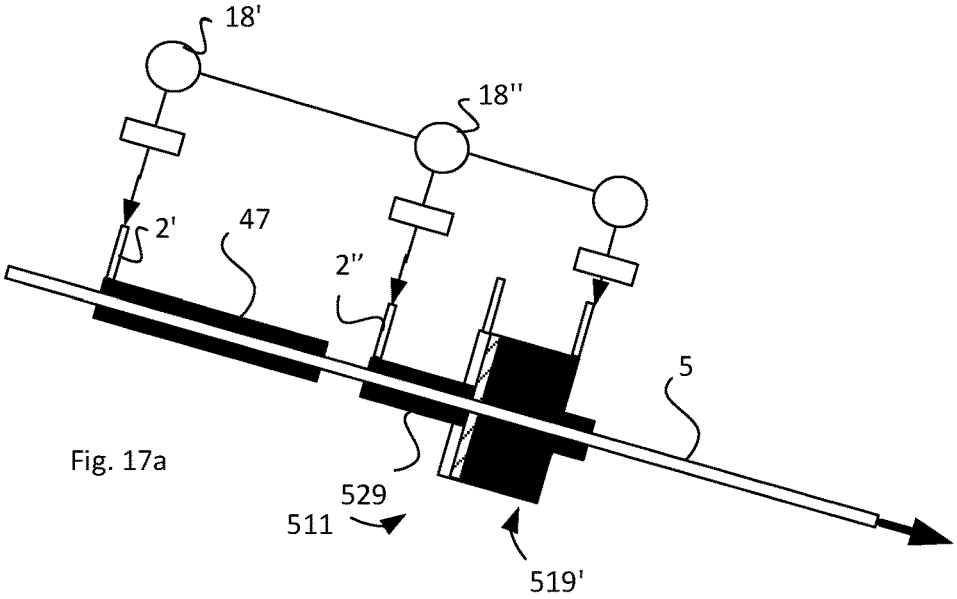
FIGS. 17*a* to 17*c* illustrate a modular fluid actuator system according to one aspect of the invention.
Figure 17B:
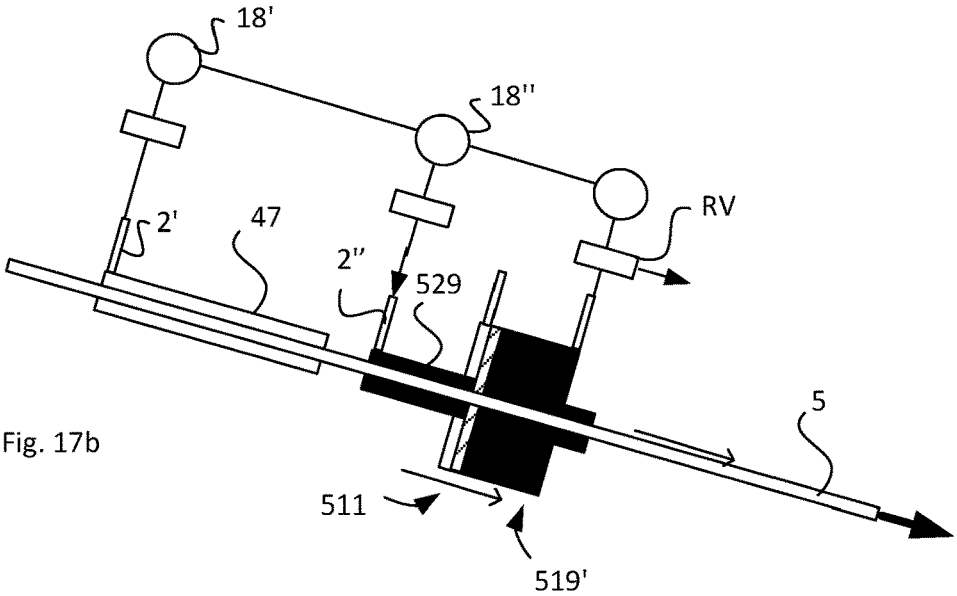
Figure 17C:
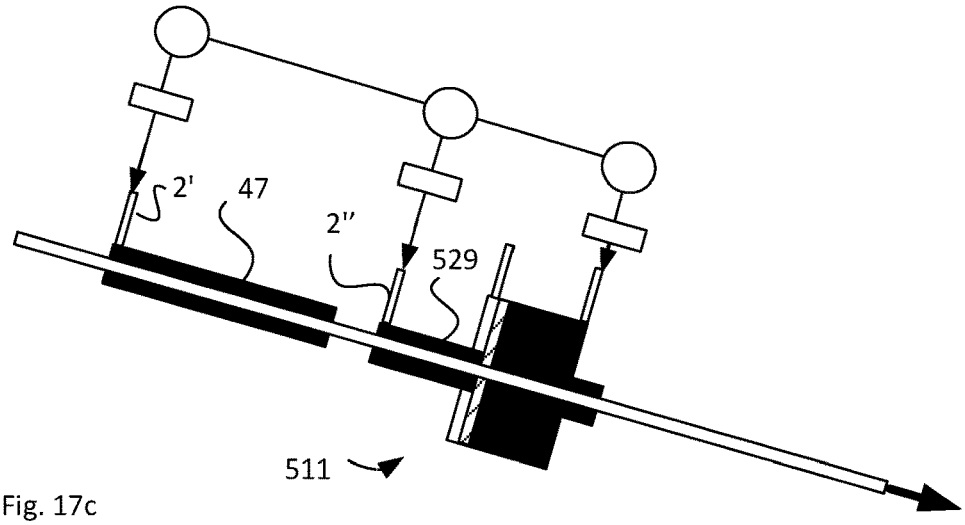

FIGS. 17*a* to 17*c* illustrate a modular fluid actuator system 3 according to one aspect of the invention used for braking or slowing or stopping the motion of the piston rod 5 and propelling the piston rod 5 providing a stepwise dynamic clamping functionality in a second mode. In FIG. 17*a* is shown that the first module unit 47 is actuated to static clamp around and brake the motion of the piston rod 5 simultaneously as the second sleeve portion 529 of the second module unit 511 is actuated to clamp around the piston rod 5 and holding the second sleeve portion 529 in position by pressurization of a first cylinder chamber 519'. In FIG. 17*b* is shown that that the first module unit 47 is disengaged from the piston rod 5 for providing a relative motion between the first module unit 47 and the piston rod 5. The second sleeve portion 529 is separately pressurized from outside for providing an engagement of the second module unit 511 to the piston rod 5 and at the same time the fluid pressure of the first cylinder chamber 519' is used for slow down the motion of the piston rod 5 by relief valve RV. In FIG. 17*c* is shown that the first module unit 47 is actuated to static clamp around and brake the motion of the piston rod 5 simultaneously as the second sleeve portion 529 of the second module unit 511 is actuated to clamp around the piston rod 5 and holding the second sleeve portion 529 in position by pressurization of a first cylinder chamber 519'. In such way is achieved an effective brake of the system 3.

Preferably, a fluid supply comprises a first separate fluid supply source 18' coupled to a first fluid transfer chamber 2'.

Suitably, the fluid supply comprises a second separate fluid supply source 18" coupled to the second fluid transfer chamber 2".

Figure 18A:
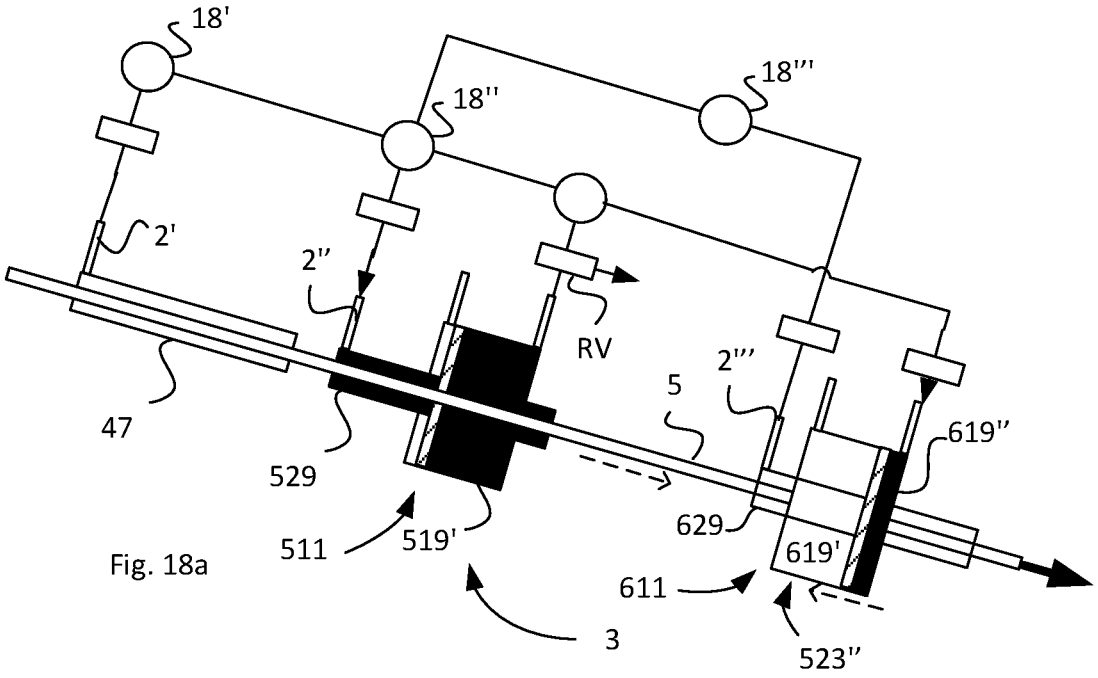
FIGS. 18*a* to 18*b* illustrate a modular fluid actuator system according to one aspect of the invention.
Figure 18B:
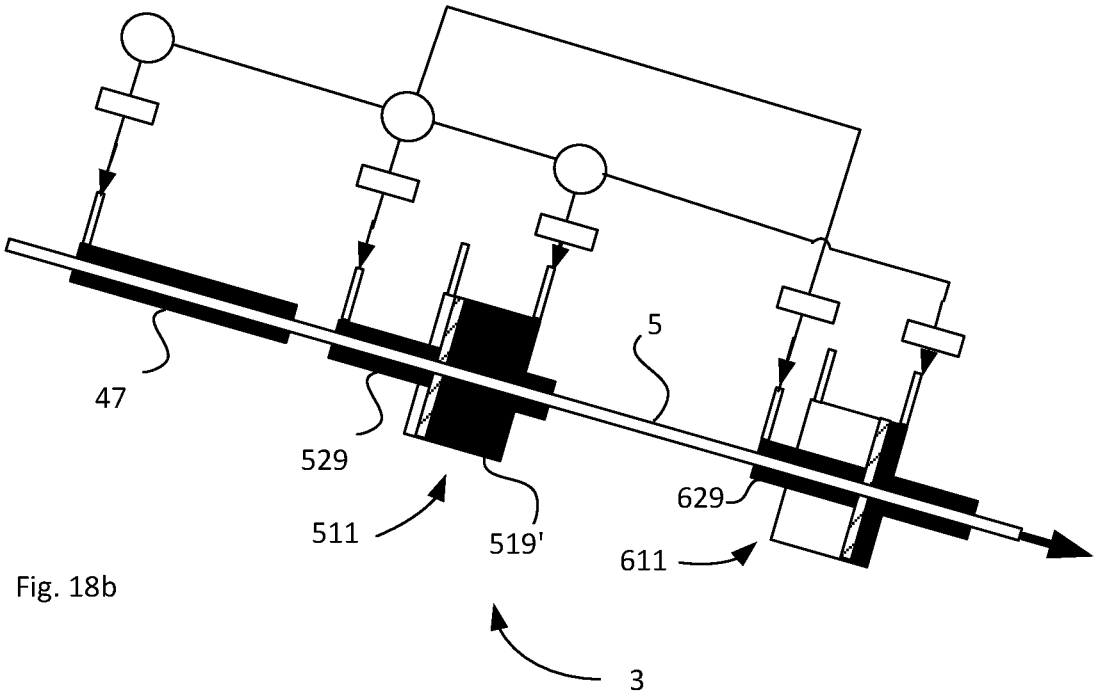

FIGS. 18*a* and 18*b* illustrate a modular fluid actuator system 3 according to one aspect of the invention. The system is used for braking (slowing or stopping) the motion of the piston rod 5 and propelling the piston rod 5 providing a substantially pulsation-free dynamic clamping functionality in a third mode. In FIG. 18*b* is shown that the first module unit 47 is actuated to static clamp around and brake the motion of the piston rod 5 simultaneously as the second sleeve portion 529 of the second module unit 511 is actuated to clamp around the piston rod 5 and holding the second sleeve portion 529 in position by pressurization of a first cylinder chamber 519'. A third module unit 611 comprising a third sleeve portion 629 is arranged for providing a substantially pulsation-free dynamic clamping functionality in a third mode. In FIG. 18*b* the first 47, the second 511 and the third module unit 611 are activated for braking (slowing or stopping) the piston rod 5. In FIG. 18*a* is shown that the first module unit 47 is disengaged from the piston rod 5 for permitting the second and third module units 511, 611 move the piston rod 5 in a substantially pulsation-free dynamic motion. The third module unit 611 comprises a third sleeve portion 629 dividing an interior of a second cylinder housing of the third module unit 611 into a first 619' and second cylinder chamber 619". The third sleeve portion 629 is disengaged from the piston rod 5 for a retraction stroke, simultaneously the second sleeve portion 529 of the second module unit 511 is engaged to the piston rod 5. The second sleeve portion 529 is separately pressurized from outside via a second fluid transfer chamber 2" of the second sleeve portion 529 for providing an engagement of the second module unit 511 to the piston rod 5 and at the same time the fluid pressure of the first cylinder chamber 519' of the second module unit 511 is used for slow down the motion of the piston rod 5 by relief valve RV.

Preferably, a fluid supply comprises a first separate fluid supply source 18' coupled to a first fluid transfer chamber 2'.

Suitably, the fluid supply comprises a second separate fluid supply source 18" coupled to the second fluid transfer chamber 2".

Preferably, the fluid supply comprises a third separate fluid supply source 18''' coupled to the third fluid transfer chamber 2''' of the third sleeve portion 629.

Suitably, the first sleeve portion of the first module unit exhibiting a first expandable hollow space is configured to be used as a component convenient to use as and matching the second sleeve portion of the second module unit.

Suitably, the first sleeve portion of the first module unit exhibiting a first expandable hollow space is configured to be used as a component convenient to use as and matching the third sleeve portion of the third module unit.

A third expandable hollow space (not shown) of the third sleeve portion 629 is arranged for fluid communication with the fluid supply 18''' via the third fluid transfer chamber 2''' (coupled to the third expandable hollow space) constituting a third external fluid inlet port of the third fluid transfer chamber 2''' positioned exterior (outside) of the second cylinder housing 523".

Figure 19A:
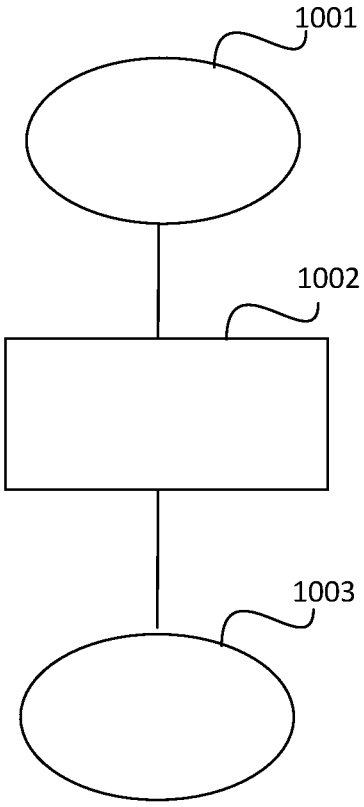
FIGS. 19*a* and 19*b* schematically illustrate a respective method of operating the modular fluid actuator system according to different aspects of the invention.

FIG. 19*a* schematically illustrates a method of operating the modular fluid actuator system according to one aspect of the invention. The modular fluid actuator system 3 is provided for generating a relative motion RM between a first fluid transfer chamber 2' of a first module unit 47 and a piston rod arrangement 5 in an axial direction X, the modular fluid actuator system 3 comprises; a fluid supply 18; a valve device 13' coupled to the fluid supply 18 and to the first fluid transfer chamber 2'; a control unit 15 coupled to the valve device 13' for controlling the relative motion RM between the first fluid transfer chamber 2' and the piston rod arrangement 5; the first fluid transfer chamber 2' is coupled to a first sleeve portion 29 of the first module unit 47 exhibiting a first expandable hollow space 535', which is coupled to and arranged for fluid communication with the valve device 13' via the first fluid transfer chamber 2'; the first expandable hollow space 535' is arranged to provide a clamping action of the first sleeve portion 29 to the piston rod arrangement 5 when the first expandable hollow space 535' is pressurised by means of said fluid communication.

Step 1001 comprises start of the method. Step 1002 comprises the steps of pressurizing of the first expandable hollow space 535' with a first pressure for providing an engagement of the first module unit 47 to the piston rod arrangement 5; pressurizing of the second expandable hollow space 535" of the second sleeve portion 529 of the second module unit 511 for providing an engagement of the second module unit 511 to the piston rod arrangement 5. Step 1003 comprises stop of the method.

Figure 19B:
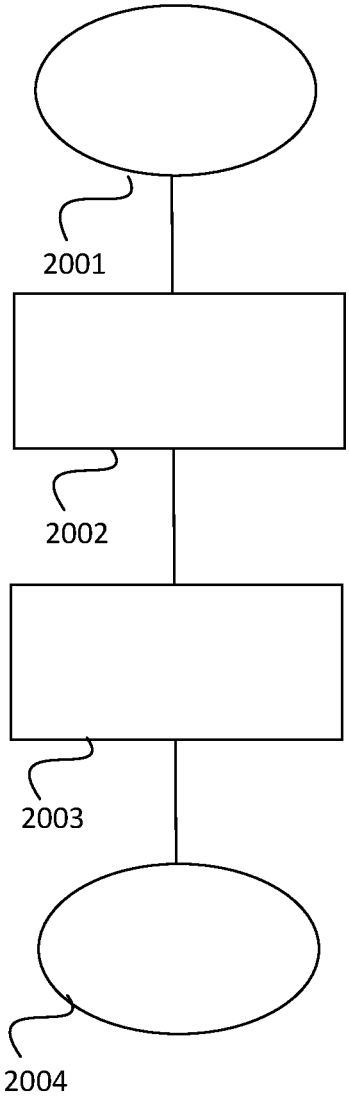

FIG. 19*b* schematically illustrates a method of operating the modular fluid actuator system according to one aspect of the invention. Step 2001 comprises start of the method. Step 2002 comprises the steps of pressurizing of the first expandable hollow space with a first pressure for providing an engagement of the first module unit to the piston rod arrangement; pressurizing of the second expandable hollow space of the second sleeve portion of the second module unit for providing an engagement of the second module unit to the piston rod arrangement. Step 2003 comprises pressurizing of the third expandable hollow space 535''' of the third sleeve portion 629 of the third module unit 611 for providing an engagement of the third module unit 611 to the piston rod arrangement 5. Step 2004 includes stop of the method.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims.

One aspect may involve that the actuator module units are adapted for momentary disengaging all pistons from the piston rod in case the piston rod propels a large mass using the kinetic energy of the mass (in a way reminding of a freewheel clutch). One aspect may involve that a clamping sleeve module unit (the first sleeve portion) may clamp (hold) rigidly to the entire circumference of the piston rod being in contact with the inner surface of the clamping sleeve module unit. One aspect may involve that a first clamping sleeve module component of a first actuator module unit having a larger piston force area than that of a second actuator module unit, preferably exhibits a longer extension seen in the axial direction than a second clamping sleeve module unit of the second actuator module unit.

The invention claimed is:

1. A modular fluid actuator system provided for generating a relative motion between a first fluid transfer chamber of a first module unit and a piston rod arrangement in an axial direction, the modular fluid actuator system comprises:

a fluid supply;

a valve device coupled to the fluid supply and to the first fluid transfer chamber; a control unit coupled to the valve device for controlling the relative motion between the first fluid transfer chamber and the piston rod arrangement;

the first fluid transfer chamber is coupled to a first sleeve portion of the first module unit exhibiting a first expandable hollow space which is coupled to and arranged for fluid communication with the valve device via the first fluid transfer chamber;

the first expandable hollow space is arranged to provide a clamping action of the first sleeve portion to the piston rod arrangement when the first expandable hollow space is pressurized by means of said fluid communications;

an expandable wall portion of the first sleeve portion is arranged adjacent around and coaxial with the piston rod arrangement;

a second module unit comprising a second sleeve portion dividing an interior of a first cylinder housing of the second module unit into a first and second cylinder chamber, wherein a second expandable hollow space of the second sleeve portion is arranged for fluid communication with the fluid supply via a second fluid transfer chamber coupled to the second expandable hollow space and positioned exterior of said first cylinder housing;

an expandable wall portion of the second sleeve portion is arranged adjacent around and coaxial with the piston rod arrangement;

the first fluid transfer chamber comprises a first external fluid inlet port and the second fluid transfer chamber comprises a second external fluid inlet port;

the first external fluid inlet port is coupled to the fluid supply via the valve device which in turn is coupled to the control unit for controlling and providing a static clamping functionality in a first mode for operation of the system; and the first module unit is configured to act as a brake module unit of the modular fluid actuator system, wherein the second external fluid inlet port is coupled to the fluid supply via a first separate valve element which in turn is coupled to the control unit for controlling and providing a stepwise dynamic clamping functionality in a second mode for operation of the system.

2. The modular fluid actuator system according to claim 1, wherein the first fluid transfer chamber is formed by a first fluid connection body or formed by a first cylinder housing.

3. The modular fluid actuator system according to claim 2, wherein the first sleeve portion comprises a first piston portion having a first piston face, the first piston portion is movable arranged in said axial direction within the first cylinder housing.

4. The modular fluid actuator system according to claim 3, wherein the first sleeve portion and the first piston portion integrally constitute a first piston body.

5. The modular fluid actuator system according to claim 3, wherein the first piston portion divides the interior of the first cylinder housing into the first cylinder chamber and a second cylinder chamber, the first expandable hollow space is arranged for fluid communication with the fluid supply via the second cylinder chamber.

6. The modular fluid actuator system according to claim 1, wherein an outer envelope surface of the first sleeve portion comprises a coupling member arranged for mounting of a first fluid connection body or a first piston portion to the first sleeve portion.

7. The modular fluid actuator system according to claim 6, wherein the coupling member comprises an orifice of a channel system arranged for fluid communication with the expandable hollow space, the orifice being arranged for coupling to an opening of the first fluid connection body or to an orifice of a channel system of said first piston portion.

8. The modular fluid actuator system according to claim 1, wherein said modular fluid actuator system being made up of individual module units coupled to each other in line axially.

9. The modular fluid actuator system according to claim 1, wherein the modular fluid actuator system further comprises a third module unit comprising a third sleeve portion dividing the interior of a third cylinder housing into a fifth cylinder chamber and a sixth cylinder chamber, a third expandable hollow space of the third second sleeve portion is arranged for fluid communication with the fluid supply via at least one of the fifth and sixth cylinder chamber.

10. The modular fluid actuator system according to claim 1, wherein the modular fluid actuator system further comprises a fourth module unit comprising a fourth sleeve portion dividing the interior of a fourth cylinder housing into a seventh cylinder chamber and an eight eighth cylinder chamber, a fourth expandable hollow space of the fourth sleeve portion is arranged for fluid communication with the fluid supply via at least one of the seventh and eight eighth cylinder chamber.

11. The modular fluid actuator system according to claim 1, wherein at least the first cylinder housing comprises a fitting member and a mounting member being formed so as to be disposed positioning the first cylinder housing in a predetermined position relative the piston rod arrangement.

12. The modular fluid actuator system according to claim 1, wherein at least two module units comprise a fitting member and a mounting member being formed so as to be disposed joining the module units and interconnecting the fitting members of the respective module unit.

13. The modular fluid actuator system according to claim 12, wherein an axial force acting between at least the two module units is taken through the fitting member and the mounting member.

14. The modular fluid actuator system according to claim 12, wherein the mounting member is arranged at a distance from at least the first sleeve portion in transverse direction and extends in the axial direction.

15. The modular fluid actuator system according to claim 12, wherein the mounting member comprises a tie rod assembly interconnecting the module units.

16. The modular fluid actuator system according to claim 12, wherein the mounting member comprises an interface hollow pipe.

17. The modular fluid actuator system according to claim 1, wherein the control unit is provided for controlling the relative motion by pressurizing the first expandable hollow space with a second pressure for disengagement of the first module unit from a piston rod arrangement.

18. The modular fluid actuator system according to claim 1, wherein the second sleeve portion comprises a first piston portion comprising a respective first and second piston face, wherein the first piston portion and a middle section of the second sleeve portion are fixedly mounted to each other and are movable arranged in said axial direction within the first cylinder housing.

19. The modular fluid actuator system according to claim 1, wherein the first cylinder chamber and the second cylinder chamber are coupled to the fluid supply via a first valve member which in turn is coupled to the control unit for controlling and providing a stepwise dynamic clamping functionality in a second mode for operation of the system and providing a reciprocating motion of the first piston portion in the axial direction.

20. The modular fluid actuator system according to claim 1, wherein the modular fluid actuator system further comprises a third module unit comprising a third sleeve portion dividing an interior of a second cylinder housing of the third module unit into a first and second cylinder chamber, wherein a third expandable hollow space of the third sleeve portion is arranged for fluid communication with the fluid supply via a third fluid transfer chamber coupled to the third expandable hollow space comprising a third external fluid inlet port positioned exterior of said second cylinder housing.

21. The modular fluid actuator system according to claim 20, wherein the third sleeve portion comprises a second piston portion comprising a respective first and second piston face, wherein the second piston portion and the third sleeve portion together are movable in said axial direction.

22. The modular fluid actuator system according to claim 20, wherein the first cylinder chamber and the second cylinder chamber are coupled to the fluid supply via a second valve member which in turn is coupled to the control unit for controlling and providing a substantially pulsation-free dynamic clamping functionality in a third mode for operation of the system and providing counter-acting reciprocating motion of the respective second sleeve portion and the third sleeve portion in the axial direction for alternately clamping action around the piston rod arrangement.

23. The modular fluid actuator system according to claim 20, wherein the third external fluid inlet port is coupled to the fluid supply via a second separate valve element which in turn is coupled to the control unit for controlling and providing a substantially pulsation-free dynamic clamping functionality in a third mode for operation of the system provided for co-acting operation with the first separate valve element.

24. The modular fluid actuator system according to claim 1, wherein the first module unit is configured to act as a brake module unit of the system.

25. The modular fluid actuator system according to claim 1, wherein the modular fluid actuator system further comprises the application of a third module unit to the assembly for providing a substantially pulsation-free dynamic clamping functionality in a third mode.

26. A method for operation of a modular fluid actuator system according to claim 1, the method comprises the steps of:

pressurizing of the first expandable hollow space with a first pressure for providing an engagement of the first module unit to the piston rod arrangement;

pressurizing of the second expandable hollow space of the second sleeve portion of the second module unit for providing an engagement of the second module unit to the piston rod arrangement.

27. The method according to claim 26, the method further comprises the step of:

pressurizing of the third expandable hollow space of the third sleeve portion of the third module unit for providing an engagement of the third module unit to the piston rod arrangement.

28. The method according to claim 26, the method further comprises the steps of:

pressurizing of the first expandable hollow space with a first pressure for providing an engagement of the first module unit to the piston rod arrangement;

pressurizing of the second expandable hollow space of the second sleeve portion of the second module unit with a second pressure for providing a disengagement of the second module unit from the piston rod arrangement and/or pressurizing of the third expandable hollow space of the third sleeve portion of the third module unit with a second pressure for providing a disengagement of the third module unit from the piston rod arrangement.

* * * * *